US006194830B1

(12) United States Patent
Cho et al.

(10) Patent No.: US 6,194,830 B1
(45) **Date of Patent: *Feb. 27, 2001**

(54) MULTI-COMPARTMENT GETTER-CONTAINING FLAT-PANEL DEVICE

(75) Inventors: Steven T. Cho, Santa Clara; Igor L. Maslennikov, Cupertino; Christopher J. Curtin, Los Altos Hills; Alfred S. Conte, Hollister, all of CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/258,247

(22) Filed: Feb. 25, 1999

Related U.S. Application Data

(62) Division of application No. 08/766,435, filed on Dec. 12, 1996, now Pat. No. 5,977,706.

(51) Int. Cl.[7] ..... H01J 17/24

(52) U.S. Cl. ..... 313/553; 313/561; 313/563; 313/495

(58) Field of Search ..... 313/553, 549, 313/561, 551, 562, 563, 481, 422, 495

(56) References Cited

U.S. PATENT DOCUMENTS

| | | | | |
|---|---|---|---|---|
| 2,855,368 | | 10/1958 | Perdijk, Jr. et al. | 252/181.6 |
| 4,131,487 | | 12/1978 | Pearce et al. | 148/1.5 |
| 4,257,827 | | 3/1981 | Schwuttke et al. | 148/1.5 |
| 4,683,154 | | 7/1987 | Benson et al. | 428/34 |
| 4,925,741 | | 5/1990 | Wong | 428/661 |
| 5,223,766 | * | 6/1993 | Nakayama et al. | 313/495 |
| 5,424,605 | | 6/1995 | Lovoi | 313/422 |
| 5,453,659 | | 9/1995 | Wallace et al. | 313/495 |
| 5,477,105 | | 12/1995 | Curtin et al. | 313/422 |
| 5,519,284 | * | 5/1996 | Pepi | 313/495 |
| 5,525,861 | | 6/1996 | Banno et al. | 313/495 |
| 5,545,946 | | 8/1996 | Wiemann et al. | 313/497 |
| 5,548,181 | | 8/1996 | Jones | 313/309 |
| 5,635,795 | | 6/1997 | Itoh et al. | 313/496 |
| 5,663,608 | | 9/1997 | Jones et al. | 313/309 |
| 5,688,708 | | 11/1997 | Kato et al. | 445/41 |
| 5,697,825 | | 12/1997 | Dynka et al. | 445/25 |
| 5,731,660 | | 3/1998 | Jaskie et al. | 313/495 |
| 5,827,102 | | 10/1998 | Watkins et al. | 445/25 |
| 5,977,706 | * | 11/1999 | Cho et al. | 313/495 |

OTHER PUBLICATIONS

Heyder et al, "Nonevaporable Gettering Technology for In–Situ Vacuum Processes," *Solid State Technology*, Aug. 1996, pp. 71–74.

Tannas, *Flat–Panel Displays and CRTs* (Van Nostrand Reinhold), Section 7.9, pp. 217–221.

"Alkali Free and Low Alkali Thin Glasses", AF 45 and D 263, Deutsche Spezialglas AG ("DESAG"), Nov. 1995, 4 pp.

(List continued on next page.)

*Primary Examiner*—Nimeshkumar D. Patel
*Assistant Examiner*—Todd Reed Hopper
(74) *Attorney, Agent, or Firm*—Skjerven Morrill MacPherson LLP; Ronald J. Meetin

(57) ABSTRACT

A getter (74) is situated in an auxiliary compartment (72) of a hollow structure (40–46 and 76) having a larger main compartment (70). The auxiliary compartment is situated outside the main compartment and is connected to the main compartment so that the two compartments reach largely the same steady-state compartment pressure. The getter is activated by directing light energy locally through part of the hollow structure and onto the getter. The light energy is typically furnished by a laser beam (60). The getter, typically of the non-evaporable type, is usually inserted as a single piece of gettering material into the auxiliary compartment. The getter normally can be activated/re-activated multiple times in this manner, typically during sealing of different parts of the structure together.

36 Claims, 13 Drawing Sheets

OTHER PUBLICATIONS

"Extend UV/IR Range Transmission Curves," *High Vacuum Elec. and Optical Ceramic–to–Metal Seal Components*, Insulator Seal Inc., 1995, p. 147.

"St 175 Nonevaporable Porous Getters," SAES Getters, Aug. 17, 1994, pp. 1–6.

Borgi, "St121 and St122 Porous Coating Getters," SAES Getters, Jul. 27, 1994, pp. 1–13.

Carella et al, "Gettering in Small Size Vacuum Micoelectronic Devices," 7th Int'l Vacuum Microelec. Conf., Jul. 1994, 5 pp.

Ferrario et al, "A New Generation of Porous Non–Evaporable Getters," SAES Getters, Dec. 13, 1993, pp. 1–8.

Giorgi et al, "High–Porosity Thick–Film Getters," *IEEE Transactions on Electron Devices*, vol. 36, No. 11, Nov. 1989, pp. 2744–2746.

* cited by examiner

Fig. 1
PRIOR ART
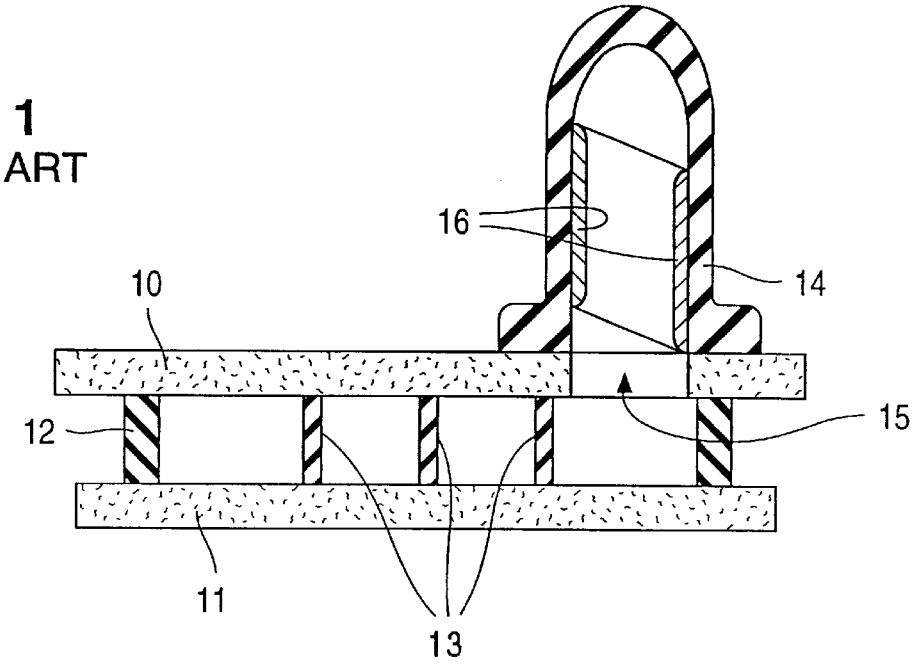
Fig. 2a
PRIOR ART
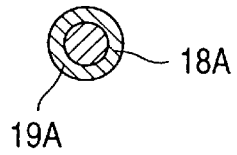
Fig. 2b
PRIOR ART
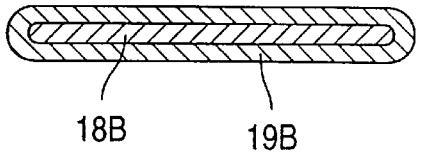
Fig. 3.1
PRIOR ART
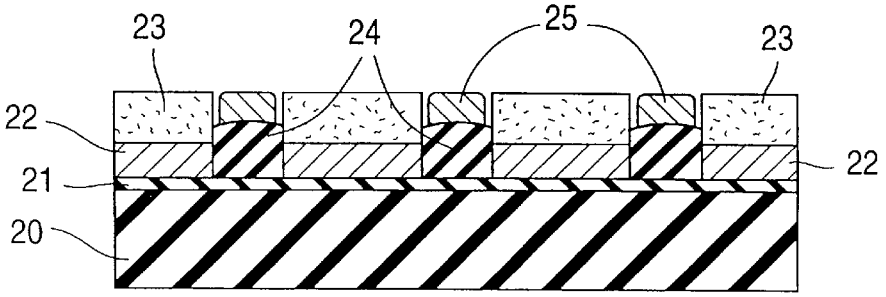

Fig. 3.2a
PRIOR ART
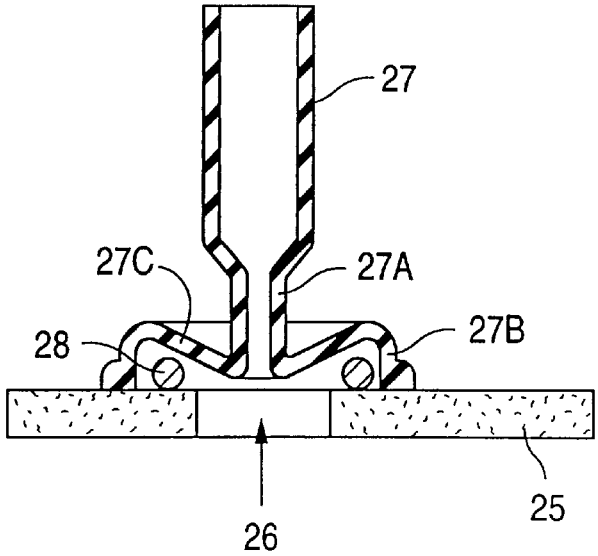
Fig. 3.2b
PRIOR ART
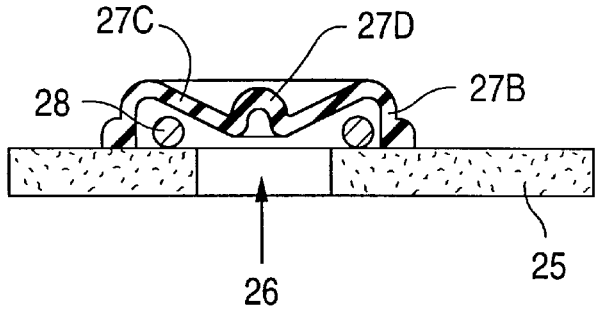
Fig. 3.3
PRIOR ART
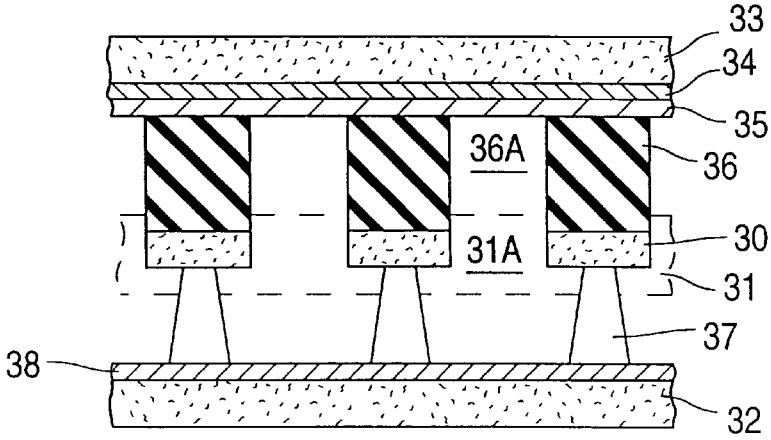

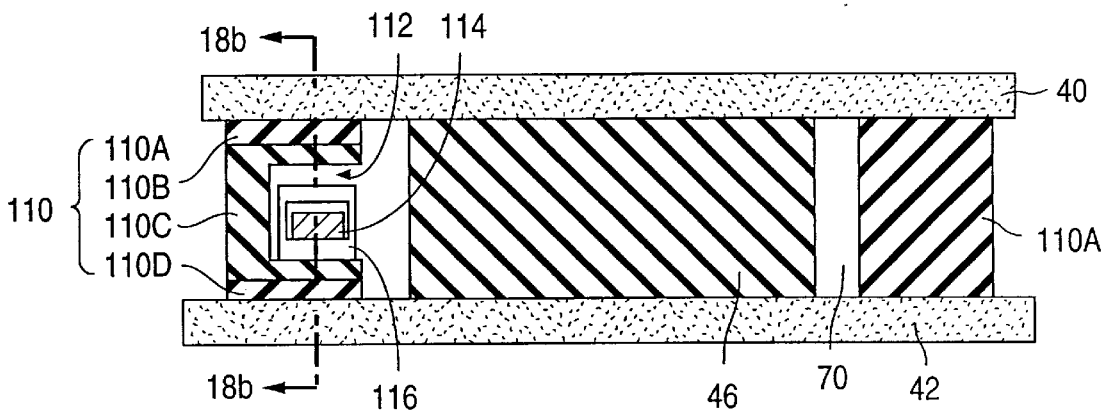
FIG. 18a
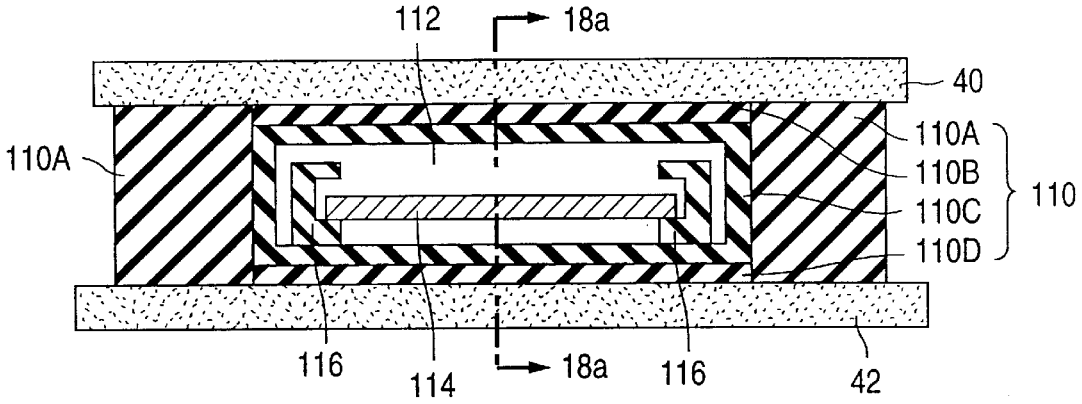
FIG. 18b
FIG. 19
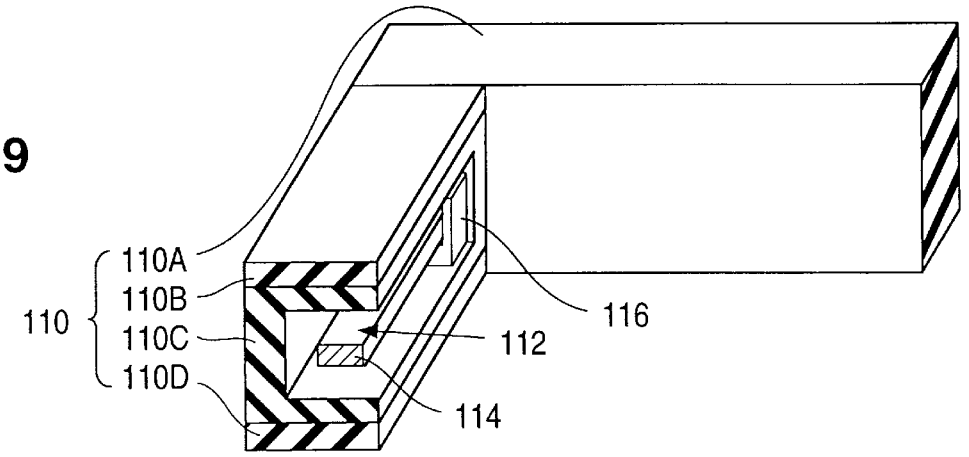

MULTI-COMPARTMENT GETTER-CONTAINING FLAT-PANEL DEVICE

CROSS REFERENCE TO RELATED APPLICATIONS

This is a division of U.S. patent application Ser. No. 08/766,435, filed Dec. 12, 1996, now U.S. Pat. No. 5,977,706 now allowed. This is also related to Pothoven et al U.S. patent application Ser. No. 08/766,688, filed Dec. 12, 1996, now U.S. Pat. No. 6,139,390. To the extent not repeated herein, the contents of Pothoven et al are incorporated by reference.

FIELD OF USE

This invention relates to gettering—i.e., the collection and removal, or effective removal, of small amounts of gases from an environment typically at a pressure below room pressure. In particular, this invention relates to techniques for activating getters used in structures such as flat-panel devices, and to structures designed to house the getters.

BACKGROUND

A flat-panel device contains a pair of generally flat plates connected together through an intermediate mechanism. The two plates are typically rectangular in shape. The thickness of the relatively flat structure formed by the two plates and the intermediate connecting mechanism is small compared to the diagonal length of either plate.

When used for displaying information, a flat-panel device is typically referred to as a flat-panel display. The two plates in a flat-panel display are commonly termed the faceplate (or frontplate) and the baseplate (or backplate). The faceplate, which provides the viewing surface, is part of a faceplate structure containing one or more layers formed over the faceplate. The baseplate is similarly part of a baseplate structure containing one or more layers formed over the baseplate. The faceplate structure and the baseplate structure are sealed together, typically through an outer wall.

A flat-panel display utilizes various mechanisms such as cathode rays (electrons), plasmas, and liquid crystals to display information on the faceplate. In a flat-panel cathode-ray tube ("CRT") display, electron-emissive elements are typically provided over the interior surface of the baseplate. When the electron-emissive elements are appropriately excited, they emit electrons that strike phosphors situated over the interior surface of the faceplate which consists of transparent material such as glass. The phosphors then emit light visible on the exterior surface of the faceplate. By appropriately controlling the electron flow, a suitable image is displayed on the faceplate.

Electron emission in a flat-panel CRT display needs to occur in a highly evacuated environment for the display to operate properly and to avoid rapid degradation in performance. The enclosure formed by the faceplate structure, the baseplate structure, and the outer wall is thus fabricated in such a manner as to be at a high vacuum, typically a pressure of $10^{-7}$ torr or less for a flat-panel CRT display of the field-emission type. Any degradation of the vacuum can lead to various problems such as non-uniform brightness of the display caused by contaminant gases that degrade the electron-emissive elements. The contaminant gases can, for example, come from the phosphors. Degradation of the electron-emissive elements also reduces the working life of the display. It is thus imperative that a flat-panel CRT display be hermetically sealed, that a high vacuum be provided in the hermetically sealed (airtight) enclosure, and that the high vacuum be maintained thereafter.

A field-emission flat-panel CRT display, commonly referred to as a field-emission display ("FED"), is conventionally sealed in air and then evacuated through tubulation provided on the display. FIG. 1 illustrates how one such conventional FED appears after the sealing and evacuation steps are completed. The FED in FIG. 1 is formed with baseplate structure 10, faceplate structure 11, outer wall 12, and multiple spacer walls 13. The FED is evacuated through pump-out tube 14, now closed, provided at opening 15 in baseplate structure 10.

Getter 16, typically consisting of barium, is commonly provided along the inside of tube 14 for collecting contaminant gases present in the sealed enclosure. This enables a high vacuum to be maintained in the FED during its lifetime. Getter 16 is of the evaporable (or flashable) type in that the barium is evaporatively deposited on the inside of tube 14.

Getter 16 typically performs in a satisfactory manner. However, tube 14 protrudes far out of the FED. Accordingly, the FED must be handled very carefully to avoid breaking getter-containing tube 14 and destroying the FED. It is thus desirable to eliminate tube 14. In so doing, the location for getter 16 along the inside of tube 14 is also eliminated.

Simply forming an evaporable barium getter at a location along the interior surface of baseplate structure 10 or/and faceplate structure 11 is unattractive. Specifically, a getter typically needs a substantial amount of surface area to perform the gas collection function. However, it is normally important that the active-to-overall area ratio—i.e., the ratio of active display area to the overall interior surface area of the baseplate (or faceplate) structure—be quite high in an FED. Because an evaporable barium getter is formed by evaporative deposition, a substantial amount of inactive area along the interior surface of the baseplate structure or/and the faceplate structure would normally have to be allocated for a barium getter, thereby significantly reducing the active-to-overall area ratio. In addition, the active components of the FED could easily become contaminated during the getter deposition process. Some of the active FED components could become short circuited.

A non-evaporable getter is an alternative to an evaporable getter. A non-evaporable getter typically consists of a pre-fabricated unit. As a result, the likelihood of damaging the components of an FED during the installation of a non-evaporable getter into the FED is considerably lower than with an evaporable getter. While a non-evaporable getter does require substantial surface area, the pre-fabricated nature of a non-evaporable getter generally allows it to be placed closer to the actual display elements than an evaporable getter.

Non-evaporable getters are manufactured in various geometries. FIGS. 2*a* and 2*b* (collectively "FIG. 2") illustrate the basic geometries for two conventional non-evaporable getters manufactured by SAES Getters. See Borghi, "St121 and St122 Porous Coating Getters," SAES Getters, Jul. 27, 1994, pages 1–13. The getter in FIG. 2*a* consists of metal wire 18A covered by coating 19A of gettering material. The getter in FIG. 2*b* consists of metal strip 18B covered by coating 19B of gettering material. A porous mixture of titanium and a zirconium-containing alloy typically forms the gettering material in these two non-evaporable getters.

Upon being placed in a highly evacuated environment, each of the getters in FIG. 2 is activated by raising the temperature of getter coating 19A or 19B to a suitably high value, typically 500° C., for a suitably long activation time, typically 10 min. At constant activation time, the getter performance can be increased by raising the activation temperature. For the getters of FIG. 2, the activation temperature can be as high as 900–950° C. above which the getters may be permanently damaged. Alternatively, as the activation temperature is increased, equivalent performance can be achieved at reduced activation time. The opposite occurs as the activation temperature is lowered to as little as 350° C. below which the gettering performance of the getters in FIG. 2 is significantly curtailed.

A getter typically consists of a porous mixture of particles that sorb gases which contact the outer surfaces of the particles. When the non-evaporable getters of FIG. 2 are activated in a high vacuum environment, sorbed gases present on the outer surfaces of the getter particles diffuse into the bulk of the getter particles, leaving their outer surfaces free to sorb more gases. The amount of gas which can be accumulated in the bulk of getter particles that are accessible to the gases is typically much more than the maximum amount of gas that the getter can sorb on the outer surfaces of the accessible particles. When the accessible outer getter surface is filled or partially filled with sorbed gases, the getter can be re-activated in a high vacuum environment to transfer the gases on the accessible outer surface to the bulk of the getter particles and again leave the accessible outer surface free to sorb more gases. Re-activation can typically be performed a relatively large number of times.

Borghi mentions three ways of activating the getters of FIG. 2 under high vacuum conditions: (a) resistive heating, (b) RF heating, and (c) indirect heating. Resistive heating is performed by passing current through metallic conductor 18A or 18B to raise the temperature of getter coating 19A or 19B to the activation temperature. The current and accompanying power are relatively high during the activation process, facts that must be taken into account in utilizing resistive heating to activate the getters. Borghi also mentions that the getters can be activated during bake-out treatments of the vacuum devices that contain the getters.

Wallace et al, U.S. Pat. No. 5,453,659, discloses a getter arrangement for an FED in which the gettering material is distributed across the active area of the faceplate structure. As shown in FIG. 3.1, the faceplate structure in Wallace et al contains transparent substrate 20, thin electrically insulating layer 21, electrically conductive anode regions 22, and phosphor regions 23. Electrically insulating material 24 of greater thickness than anode regions 22 is situated in the spaces between regions 22. Gettering material 25 is situated on insulating material 24 and is spaced apart from phosphor regions 23. Wallace et al indicates that getter material 25 can be barium or a zirconium—vanadium—iron alloy.

Getter material 25 in Wallace is initially activated during assembly of the FED under high vacuum conditions at 300° C. Wallace et al also provides circuitry, including electrical conductors connected to getter material 25, for re-activating getter material 25.

The getter arrangement of Wallace et al appears relatively efficient in terms of area usage. However, getter material 25 is relatively complex in shape and requires manufacturing steps that could be unduly expensive. The necessity to maintain space between getter material 25 and phosphor regions 23 raises reliability concerns. The provision of circuitry to re-activate getter material 25 raises further reliability concerns and also further increases the fabrication cost. It would be desirable to have a simple technique for activating/re-activating a getter, especially one of relatively simple design, in a flat-panel device without raising the reliability concerns of Wallace et al, without incurring high getter installation costs, and without using an awkward getter-containing attachment such as the pump-out tubulation commonly used with evaporable getters in FEDs.

Pepi, U.S. Pat. No. 5,519,284, discloses a composite getter/pump-out arrangement that overcomes much of the awkwardness present in the conventional getter/pump-out arrangement of FIG. 1. FIG. 3.2*a* shows Pepi's getter/pump-out arrangement in which plate 25 of a flat display screen, such as an FED, has pump-out aperture 26. Pump-out tube 27 overlies aperture 26 and is bonded to the exterior surface of plate 25. Pump-out tube 27 has constricted portion 27A which broadens into circular cylindrical portion 27B having concave wall 27C. A group of getters 28 lie on the exterior surface of plate 25 below concave wall 27C. Pepi specifies that getters 28 may consist of cylindrical bars or strips. Pepi also discloses that the gettering material may be evaporatively deposited onto broadened tube portion 27B.

Pepi's flat display screen is pumped out through tube 27. Subsequently, tube 27 is closed at constricted portion 27A as shown in FIG. 3.2*b*. The closure operation is performed in such a way that the remainder 27D of constricted portion 27A lies below the highest part of broadened tube portion 27B.

Pepi's getter/pump-out arrangement enables getters 28 to be located in a pump-out tube which, after tube closure, does not protrude far from the flat display screen. This should reduce the likelihood of damaging the display compared to the getter/pump-out arrangement of FIG. 1. However, closing tube 27 appears to involve heating constricted portion 27A along a location very close to concave wall 27C. Undesired stresses may be produced in concave portion 27C, thereby forming a weak point in the display. Also, when getter material is evaporatively deposited onto broadened tube portion 27B (including concave wall 27C), some of the evaporated getter material may pass through pump-out aperture 26 and contaminate the active display elements. It would be desirable to have a simple FED getter arrangement that overcomes the disadvantages of Pepi's arrangement and is suitable for a non-evaporable getter.

FIG. 3.3 illustrates the FED of Wiemann et al, U.S. Pat. No. 5,545,946, in which gated electron emitters 30 are provided in substrate 31 situated between backplane 32 and a faceplate structure consisting of faceplate 33, anode layer 34, and cathodoluminescent material layer 35. Electrons emitted from gated emitters 30 enter substrate apertures 31A and then move through interspace apertures 36A in electrically insulating layer 36 to strike cathodoluminescent material 35. Spacers 37 maintain a fixed spacing between electron emitters 30 and thin gettering layer 38 overlying backplane 32. Getter 38, which appears to be maintained at negative potential relative to anode layer 34, collects contaminant gases present in apertures 36A and 31A and the evacuated region between substrate 31 and getter 38.

By having gettering layer 38 situated on a different level than emitter-containing substrate 30 or the faceplate structure, the FED of Wiemann et al achieves a high active-to-overall area ratio. This is advantageous. However, it is not clear how getter 38 is activated or whether it can be reactivated. Furthermore, the presence of getter 38 and accompanying spacers 37 causes the overall thickness of the FED to be significantly increased, an undesirable result. In an FED containing a getter, it would be desirable to achieve a high active-to-overall area ratio without having the presence of the getter cause a significant increase in the overall FED thickness.

GENERAL DISCLOSURE OF THE INVENTION

The present invention employs local energy transfer to activate a getter situated in an auxiliary compartment of a hollow structure, such as a flat-panel device, having a larger main compartment. The auxiliary compartment is situated outside the main compartment and is connected pressure-wise to the main compartment so that the two compartments reach largely equal steady-state compartment pressures. In accordance with the invention, light energy is directed locally through a portion of a hollow structure and onto the getter to activate the getter and enable it to collect gases. The term "local" or "locally" as used here in describing an energy transfer means that the energy is directed selectively to certain material largely intended to receive the energy without being significantly transferred to nearby material not intended to receive the energy.

The local energy transfer is typically performed by directing a laser beam onto the getter. By activating the getter with a laser, the getter can be of relatively simple configuration. For example, a getter activated according to the present invention preferably consists of a single piece of gettering material, typically of the non-evaporable type, inserted into the auxiliary compartment of the hollow structure before the activation step. The invention thus avoids the reliability concerns and high manufacturing costs commonly associated with complex getter designs such as that of Wallace et al.

The hollow structure typically contains a first plate structure, a second plate structure, and an outer wall that extends between the plate structures to form the main compartment. Active display elements, such as electron-emissive elements and light-emissive elements that emit light upon being struck by electrons emitted from the electron-emissive elements, are usually provided in the plate structures. The hollow structure preferably further includes an auxiliary wall that contacts the first plate structure and extends away from the first plate structure and main compartment to form the auxiliary compartment. Control circuitry is typically provided over the first plate structure outside the main compartment to the side of the auxiliary compartment.

When arranged in the preceding way, the getter-containing auxiliary compartment does protrude away from the main compartment. However, the amount of protrusion is normally small compared to what occurs in the prior art FED of FIG. 1. In particular, the auxiliary compartment normally does not extend substantially further away from the first plate structure than the control circuitry provided over the first plate structure. Consequently, the amount of additional care that must be exercised in handling the present hollow structure to avoid damaging the auxiliary compartment and control circuitry is not significantly greater than the amount of additional handling care that must be exercised to avoid damaging just the control circuitry. Contrary to what occurs with getter-containing tube 14 in the prior art FED of FIG. 1, the presence of the getter-containing auxiliary compartment here does not significantly raise the level of necessary handling care.

For the case in which the hollow structure is a flat-panel display, arranging the display in the preceding way so that the getter-containing auxiliary compartment at least partially overlies the first plate structure leads to a high active-to-overall area ratio while simultaneously permitting the getter to be made relatively large. This is highly beneficial. Since the auxiliary compartment does not extend significantly further away from the first plate structure than the control circuitry that overlies the first plate structure, the overall thickness of the display depends on the thickness of the control circuitry. The presence of the auxiliary compartment does not lead to any significant increase in the overall display thickness beyond that mandated by the control circuitry. Consequently, the so-configured display makes extremely efficient usage of the total volumetric space typically available for the display.

The getter-activation process is normally performed by passing the laser beam through transparent material of the auxiliary wall used in forming the getter-containing auxiliary compartment. The getter is activated upon being raised to a temperature of 300–950° C., preferably 700–900° C., by the laser beam. Although the getter itself is raised to a highly elevated temperature, the energy transfer that occurs during the activation process normally does not cause any significant heating of the auxiliary wall, the plate structures, or the outer wall.

In particular, very little of the light energy of the impinging laser beam is absorbed directly by transparent auxiliary-wall material through which the laser beam passes. When the laser beam is scanned only once across each part of the getter, only a small part of the getter is at high temperature at any time so that radiation-produced secondary heating is very small. The absence of significant heating of the auxiliary wall, the plate structures, and the outer wall in the invention is a large advantage over a resistively heated getter where a conductor that carries current for activating the getter would likely have to pass through a wall and where the energy transfer that arises from the attendant ohmic heating of the conductor could readily lead to melting of parts of the wall due to the high current needed to activate the getter.

The pressure in the hollow structure during the laser-based getter-activation step of the invention is generally below room pressure. The pressure is typically at a high vacuum level of $10^{-2}$ torr or less. Accordingly, the present getter-activation technique is suitable for applications, such as flat-panel CRT displays, where a high vacuum is needed. Nonetheless, the getter-activation technique of the invention can be employed in devices, such as plasma displays or plasma-addressed liquid-crystal displays, where the internal pressure exceeds $10^{-2}$ torr, typically due to the presence of inert gas. In either case, the getter chemically sorbs gases present in the hollow structure, including gases that move from the main compartment to the auxiliary compartment.

The invention also provides highly advantageous structures for a flat-panel device having a main compartment and a getter-containing auxiliary compartment. The main compartment in the present flat-panel device is formed with a first plate structure, a second plate structure, and a generally annular outer wall that extends between the plate structures.

In one embodiment of the present flat-panel device, the auxiliary compartment is formed with an auxiliary wall that contacts the first plate structure outside the main compartment, extends away from the first plate structure and the main compartment, bends back towards the second plate structure, and contacts the second plate structure outside the main compartment. The auxiliary compartment is connected to the main compartment so that the two compartments reach largely equal steady-state compartment pressures. The getter is situated in the auxiliary compartment.

The preceding multi-compartment structure in which both plate structures are utilized in forming the auxiliary compartment is somewhat more complex than a multi-compartment structure in which only one of two plate structures that form a main compartment with an intervening outer wall is employed in forming an adjoining auxiliary compartment. However, interconnection of the two compartments in the multi-compartment structure of the invention can be made through one or more openings in the outer wall. There is no need to make the interconnection through one of the plate structures as would normally be necessary in the simpler structure where only one of the plate structures is utilized in forming the auxiliary compartment. The present multi-compartment structure thereby avoids structural weakness that could occur due to openings provided through one of the plate structures.

In another embodiment of the present flat-panel device, the outer wall has an interior wall surface that faces the main compartment. A cavity, which serves as the auxiliary compartment, extends from the interior wall surface partially through the outer wall. The getter is situated at least partially in the cavity. Configuring the flat-panel device in this way facilitates device manufacture since there is no need to provide openings through a wall of the main compartment in order to connect the getter-containing cavity to the main compartment. Situating the getter-containing cavity in the outer wall permits the outer wall to be made sufficiently thick to achieve hermetic sealing of the device without having the getter overlie the internal area of the main compartment, thereby reducing the overall size of the flat-panel device.

In short, the present invention furnishes useful structures for housing a getter in a flat-panel device, as well as a simple technique for activating a getter placed in a flat-panel device, especially a flat-panel display of the CRT type where a high vacuum is needed to achieve high display performance. Importantly, the getter can have a very simple configuration—e.g., a single piece of non-evaporable gettering material. Installation and activation of the getter can be performed in an inexpensive manner. The likelihood of damaging the hollow structure due to energy transfer during the activation process is very low in the invention. The getter can be made quite large without significantly increasing the overall device thickness or the overall device area. The invention thus provides a large advance over the prior art.

BRIEF DESCRIPTION OF THE DRAWINGS

FIG. 1 is a cross-sectional view of a conventional flat-panel CRT display having pump-out tubulation that contains an evaporable getter.

FIGS. 2*a* and 2*b* are cross-sectional views of conventional non-evaporable getters.

FIG. 3.1 is a cross-sectional view of a getter-containing faceplate structure of a prior art flat-panel CRT display.

FIGS. 3.2*a* and 3.2*b* are cross-sectional views of the getter/pump-out arrangement in a conventional flat display screen respectively before and after closure of pump-out tubulation.

FIG. 3.3 is a cross-sectional view of a conventional flat-panel CRT display in which a gettering layer lies on a backplane spaced apart from a substrate containing electron emitters.

FIGS. 18*a* and 18*b* are cross-sectional side views of another flat-panel CRT display configured in accordance with the invention so as to have a main compartment and a smaller auxiliary compartment that contains a getter suitable for being laser activated according to the invention. The cross section of FIG. 18*a* is taken through plane 18*a*—18*a* in FIG. 18*b*. The cross section of FIG. 18*b* is taken through plane 18*b*—18*b* in FIG. 18*a*.

FIG. 19 is a perspective view of a portion of the outer wall in the flat-panel CRT display of FIGS. 18*a* and 18*b*.

Like reference symbols are employed in the drawings and in the description of the preferred embodiments to represent the same, or very similar, item or items.

DESCRIPTION OF THE PREFERRED EMBODIMENTS

Figure 5A:
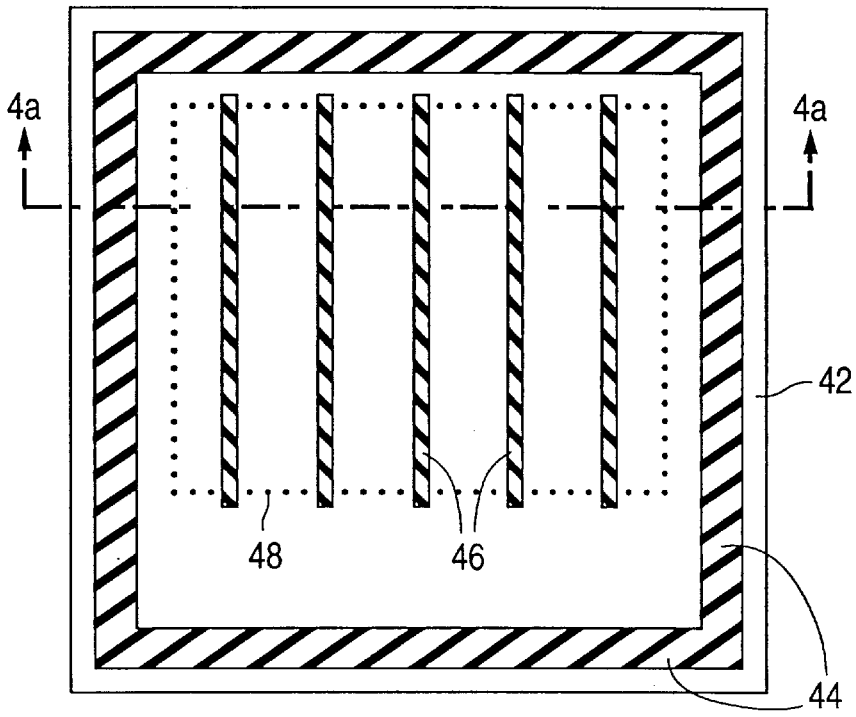
FIGS. 5*a* and 5*b* are respective cross-sectional plan views of the faceplate structure and overlying components in FIGS. 4*a* and 4*b*. The cross sections of FIGS. 5*a* and 5*b* are taken respectively through planes 5*a*—5*a* and 5*b*—5*b* in FIGS. 4*a* and 4*b*. The cross sections of FIGS. 4*a* and 4*b* are respectively taken through planes 4*a*—4*a* and 4*b*—4*b* in FIGS. 5*a* and 5*b*.
Figure 5B:
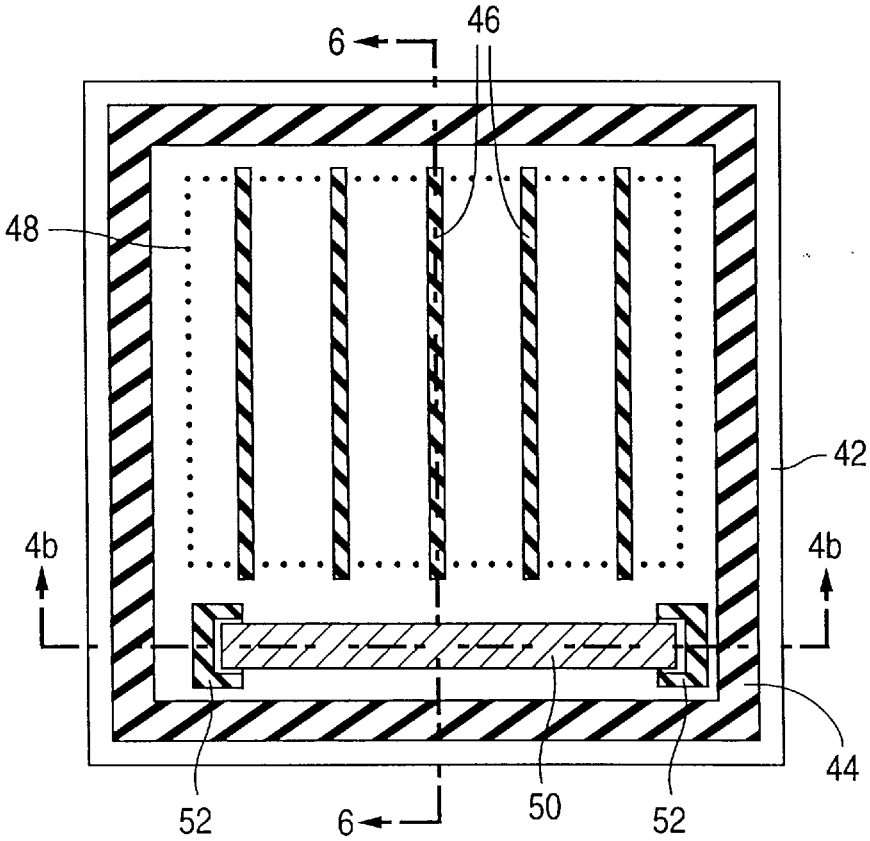
Figure 6:
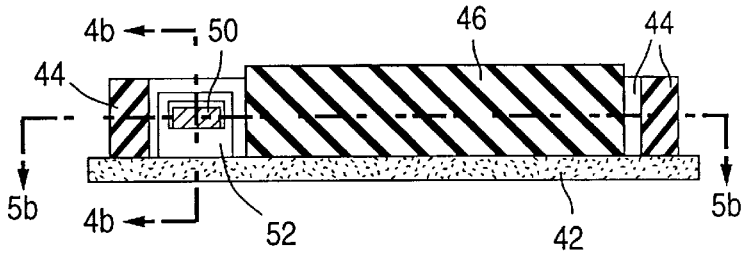
FIG. 6 is another cross-sectional side view of the faceplate structure and overlying components in FIGS. 4*b* and 5*b*. The cross section of FIG. 6 is taken through plane 6—6 in FIGS. 4*b* and 5*b*. The cross sections of FIGS. 4*b* and 5*b* are respectively taken through planes 4*b*—4*b* and 5*b*—5*b* in FIG. 6.

FIGS. 4*a*–4*h* (collectively "FIG. 4") illustrate how a non-evaporable getter of a flat-panel display is laser activated during the assembly, including the hermetic sealing, of the display. Side views are generally presented in FIG. 4. FIGS. 5*a* and 5*b* (collectively "FIG. 5") depict top views of the faceplate structure and the overlying components of the flat-panel display at the stages respectively shown in FIGS. 4*a* and 4*b*. FIG. 6 illustrates a side view of the faceplate structure and overlying components at the stage shown in FIG. 4*b* but in a plane perpendicular to the plane of FIG. 4*b*.

As used herein, the "exterior" surface of a faceplate structure in a flat-panel display is the surface on which the display's image is visible to a viewer. The opposite side of the faceplate structure is referred to as its "interior" surface even though part of the interior surface of the faceplate structure is normally outside the enclosure formed by sealing the faceplate structure to a baseplate structure through an outer wall. Likewise, the surface of the baseplate structure situated opposite the interior surface of the faceplate structure is referred to as the "interior" surface of the baseplate structure even though part of the interior surface of the baseplate structure is normally outside the sealed enclosure formed with the two plate structures and the outer wall. The side of the baseplate structure opposite to its interior surface is referred to as the "exterior" surface of the baseplate structure.

With the foregoing in mind, the components of the flat-panel display assembled according to the process of FIG. 4 include a baseplate structure 40, a faceplate structure 42, an outer wall 44, and a group of spacer walls 46. Baseplate structure 40 and faceplate structure 42 are generally rectangular in shape. The internal constituency of plate structures 40 and 42 is not shown. However, baseplate structure 40 consists of a baseplate and one or more layers formed over the interior surface of the baseplate. Faceplate structure 42 consists of a transparent faceplate and one or more layers formed over the interior surface of the faceplate. Outer wall 44 consists of four sub-walls arranged in a rectangle. Spacer walls 46, which extend across active display area 48 as indicated in FIG. 5*a*, maintain a constant spacing between plate structures 40 and 42 in the sealed display and provide strength to the display.

A flat-panel display assembled according to the process of FIG. 4 can be anyone of a number of different types of high-vacuum flat-panel displays such as CRT displays and vacuum fluorescent displays as well as any one of a number of reduced-pressure flat-panel displays such as plasma displays and plasma-addressed liquid-crystal displays. In a flat-panel CRT display that operates according to field-emission principles, baseplate structure 40 contains a two-dimensional array of picture elements ("pixels") of electron-emissive elements provided over the baseplate. The electron-emissive elements form a field-emission cathode.

In particular, baseplate structure 40 in a field-emission display (again, "FED") typically has a group of emitter row electrodes that extend across the baseplate in a row direction. An inter-electrode dielectric layer overlays the emitter electrodes and contacts the baseplate in the space between the emitter electrodes. At each pixel location in baseplate structure 40, a large number of openings extend through the inter-electrode dielectric layer down to a corresponding one of the emitter electrodes. Electron-emissive elements, typically in the shape of cones or filaments, are situated in each opening in the inter-electrode dielectric.

A patterned gate layer is situated on the inter-electrode dielectric. Each electron-emissive element is exposed through a corresponding opening in the gate layer. A group of column electrodes, either created from the patterned gate layer or from a separate column-electrode layer that contacts the gate layer, extend over the inter-electrode dielectric in a column direction perpendicular to the row direction. The emission of electrons from the pixel at the intersection of each row electrode and each column electrode is controlled by applying appropriate voltages to the row and column electrodes.

Faceplate structure 42 in the FED contains a two-dimensional array of phosphor pixels formed over the interior surface of the transparent faceplate. An anode, or collector electrode, is situated adjacent to the phosphors in structure 42. The anode may be situated over the phosphors, and thus is separated from the faceplate by the phosphors. In this case, the anode typically consists of a thin layer of electrically conductive light-reflective material, such as aluminum, through which the emitted electrons can readily pass to strike the phosphors. The light-reflective layer increases the display brightness by redirecting some of the rear-directed light back towards the faceplate. U.S. Pat. Nos. 5,424,605 and 5,477,105 describe examples of FEDs having faceplate structure 42 arranged in the preceding manner. Alternatively, the anode can be formed with a thin layer of electrically conductive transparent material, such as indium tin oxide, situated between the faceplate and the phosphors.

When the FED is arranged in either of the preceding ways, application of appropriate voltages to the row and column electrodes in baseplate structure 40 causes electrons to be extracted from the electron-emissive elements at selected pixels. The anode, to which a suitably high voltage is applied, draws the extracted electrons towards phosphors in corresponding pixels of faceplate structure 42. As the electrons strike the phosphors, they emit light visible on the exterior surface of the faceplate to form a desired image. For color operation, each phosphor pixel contains three phosphor sub-pixels that respectively emit blue, red, and green light upon being struck by electrons emitted from electron-emissive elements in three corresponding sub-pixels formed over the baseplate.

Baseplate structure 40 is to be hermetically sealed to faceplate structure 42 through outer wall 44. At the stage shown in FIGS. 4*a* and 5*a*, outer wall 44 has been sealed (or joined) to faceplate structure 42. Outer wall 44 typically consists of frit arranged in a rectangular annulus. Spacer walls 44 are mounted on the interior surface of faceplate structure 42 within outer wall 44. Spacer walls 46 are normally taller than outer wall 44. The hermetic sealing of composite structure 42/44/46 to structure 40 is to occur along (a) an annular rectangular sealing area formed by the upper edge 44S of outer wall 44 and (b) an annular rectangular sealing area 40S along the interior surface of baseplate structure 40.

Baseplate structure 40 is transparent along at least part of, normally the large majority of, sealing area 40S and the area where light energy for getter activation is to pass. Opaque electrically conductive (normally metal) lines in baseplate structure 40 typically cross sealing area 40S. Where such crossings occur, these opaque lines are sufficiently thin that they do not significantly impact the local transfer of light energy through structure 40.

A getter structure consisting of a non-evaporable getter strip 50 and a pair of thermally (and electrically) insulating getter supports 52 is installed over the interior surface of faceplate structure 42 within outer wall 44. See FIGS. 4*b*, 5*b*, and 6. As shown in FIG. 5*b*, getter structure 50/52 is situated outside active display area 48. Getter supports 52 are bonded to faceplate structure 42. The ends of non-evaporable getter strip 50 are situated in slot-shaped cavities located partway up the height of supports 52. The slots are slightly narrower than the width of supports 52. The slots are also slightly bigger than the getter width and thickness at the ends of getter strip 50 so as to allow room for thermal expansion.

With getter structure 50/52 so arranged, non-evaporable getter 50 is spaced apart from faceplate structure 42, outer wall 44, and spacer walls 46. Also, when baseplate structure 40 is bonded to faceplate structure 42 through outer wall 44, getter 50 will also be spaced apart from baseplate structure 40. This enables both the top and bottom surfaces of getter strip 50, along with its side edges, to provide gas collection action. Since getter supports 52 are thermal (and electrical) insulators, getter 50 is thermally (and electrically) insulated from faceplate structure 42, outer wall 44, and spacer walls 46 and will be thermally (and electrically) insulated from baseplate structure 40.

Non-evaporable getter 50 is typically configured internally as shown in FIG. 2*b*. Interior strip 18B usually consists of nichrome or nickel. Getter coating 19B consists of a porous mixture of titanium and either a gettering alloy of zirconium and aluminum or a gettering alloy of zirconium, vanadium, and iron. For example, getter 50 is typically a getter strip akin to the St121 or St122 getter strip available from SAES Getters. The thickness of interior strip 18B is 0.02–0.1 mm, while the total getter thickness is 0.1–0.5 mm The getter width is in the vicinity of 2 mm.

The outside surface of getter 50 is normally chosen so as to be sufficiently large to provide adequate gettering capacity for the entire flat-panel display. If, however, the outside surface of getter 50 is insufficient to achieve the requisite gettering capacity in the space available for getter 50 in that part of the display, one or more additional getter structures configured similarly to getter structure 50/52 can be provided elsewhere over the interior surface of faceplate structure 42. For example, another such getter structure can be provided on the opposite side of active area 48 from where getter structure 50/52 is located. If there are advantages to small getter structures or limitations on fabricating large getter structures, one or more getter structures configured similarly to getter structure 50 can also be provided next to getter structure 50/52.

Getter supports 52 are normally slightly shorter than outer wall 44. Except for the slots that receive getter 50, supports 52 are generally rectangular solids. Supports 52 are typically formed by a suitable molding process. Pieces of suitable support material could also be machined to produce supports 52.

If getter strip 50 is so long that it is likely to bend and touch baseplate structure 40 or faceplate structure 42 due to the influence of gravity or/and other forces, one or more additional thermally (and electrically) insulating supports are provided along getter 50 to prevent it from touching structure 40 or 42. One part of each additional getter support lies between baseplate structure 42 and getter 50, while another part of each additional support overlies getter 50 so as to ensure that it is spaced apart from baseplate structure 40. Because the presence of additional getter supports occupies getter area, the number of additional getter supports is preferably kept as low as reasonable.

Figure 4A:
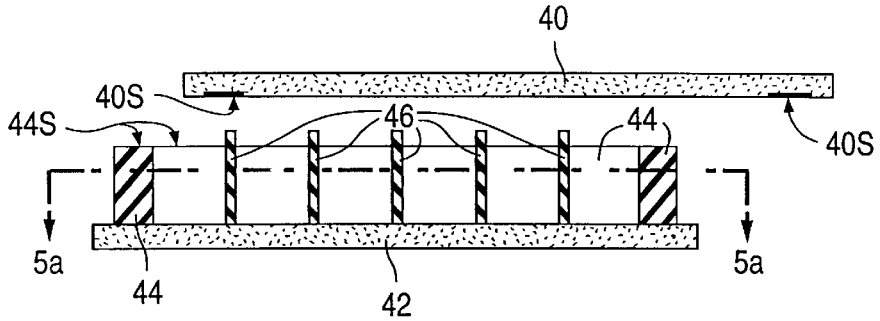
FIGS. 4*a*–4*h* are cross-sectional side views representing steps in laser activating a getter of a flat-panel display.
Figure 4B:
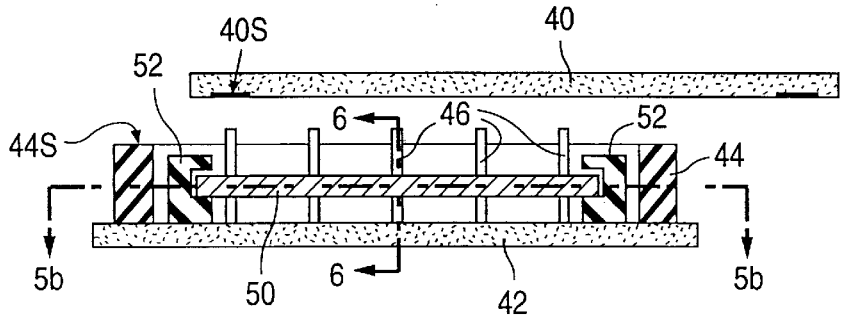
Figure 4C:
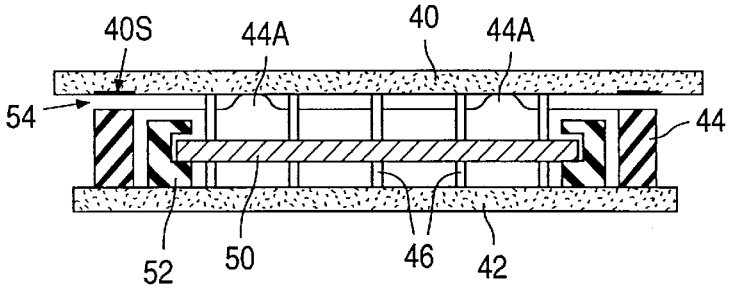

Using a suitable alignment system (not shown), structures 40 and 42/44/46/50/52 are positioned relative to one another in the manner shown in FIG. 4*c*.

This entails aligning sealing areas 40S and 44S (vertically in FIG. 4*c*) and bringing the interior surface of baseplate structure 40 into contact with the upper edges of spacer walls 46. Because getter supports 52 are shorter than outer wall 44 and thus are shorter than spacer walls 46, baseplate structure 40 is spaced vertically apart from supports 52. The alignment is done optically in a non-vacuum environment, normally at room pressure, with alignment marks provided on plate structures 40 and 42 for aligning them, thereby causing sealing areas 40S and 44S to be aligned. Plate structures 40 and 42 and outer wall 44 now form a hollow structure having a cavity in which spacer walls 46 and getter structure 50/52 are situated. Spacer walls 46 are sufficiently taller than outer wall 44 that a gap 54 extends between sealing areas 44S and 40S.

With structures 40 and 42/44/46/50/52 situated in the alignment system, a tacking operation is performed to hold structure 40 in a fixed position relative to structure 42/44/46/50/52. Techniques for performing the tacking operation and the subsequent gap-jumping final sealing operation are described in Cho et al, U.S. patent application Ser. No. 08/766,477, filed Dec. 12, 1996, now U.S. Pat. No. 6,109,994 the contents of which are incorporated by reference to the extent not repeated herein.

In the process of FIG. 4, the tacking operation is typically performed with a laser (unshown) that tacks structure 40 to structure 42/44/46/50/52 at several locations along aligned sealing areas 40S and 44S. See FIG. 4*c*. The tacking operation causes portions 44A of outer wall 44 to protrude upward and become firmly bonded to baseplate structure 40. The tacking operation can alternatively be performed with separate tack posts situated outside outer wall 44 and tacked to plate structures 40 and 42 with suitable glue.

Figure 4D:
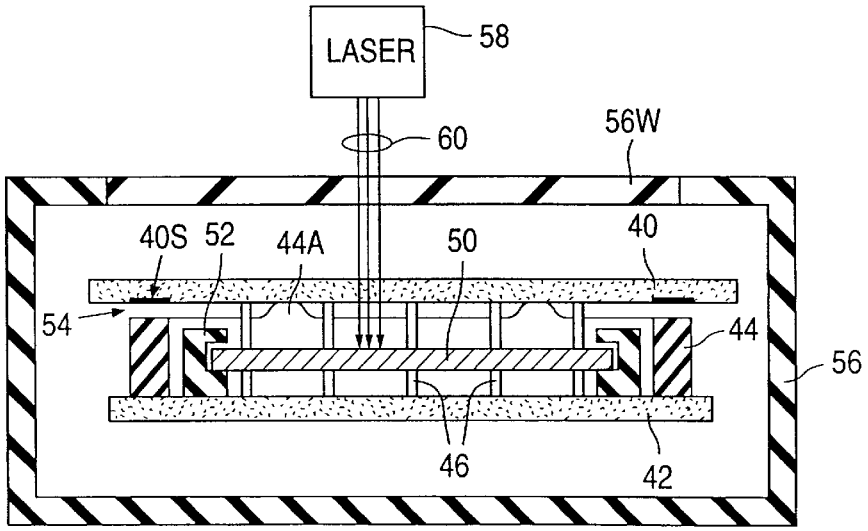

The tacked/partially sealed flat-panel display is removed from the alignment system and placed in a vacuum chamber 56, as shown in FIG. 4*d*, for laser activating getter 50 and performing other operations to complete the hermetic seal. Vacuum chamber 56 is pumped from room pressure down to a high vacuum at a pressure no greater than $10^{-2}$ torr, typically $10^{-6}$ torr or lower.

A laser 58 that produces a laser beam 60 is located outside vacuum chamber 56. Laser 58 is arranged so that laser beam 60 can pass through a transparent window 56W of chamber 56 and then through transparent material of baseplate structure 40 so as to impinge on getter 50. Window 56W typically consists of quartz.

The transparent material of baseplate structure 40 normally consists of glass. Laser beam 60 has a major wavelength at which the glass does not significantly absorb light energy. For example, when the transparent material of baseplate structure 40 consists of Schott D263 glass, the wavelength of laser beam 60 is in the approximate range of 0.3–2.5 μm across which Schott D263 glass strongly transmits light. As used here in connection with light transmission, "strongly" means at least 90% transmission. Consequently, very little of the thermal energy of laser beam 60 is transferred directly to baseplate structure 40 when laser beam 60 passes through the transparent material of structure 40. Nor is substantially any of the thermal energy of laser beam 60 normally transferred directly to faceplate structure 42, outer wall 44, or any of spacer walls 46.

Laser 58 can be implemented with anyone of a number of different types of lasers such as a semiconductor diode laser, a carbon dioxide laser (with the beam offset by 90°), an ultraviolet laser, or a neodymium YAG laser. For example, laser 58 is typically a diode laser such as the Optopower OPCA 015-810-FCPS continuous-wave integrated fiber-coupled diode laser module whose beam wavelength is approximately 0.85 μm. The laser power is typically 2–5 w. The width of getter strip 50 is typically no more than the diameter of laser beam 60. For a 2-mm width of getter 50, the diameter of beam 60 is typically 3 mm.

With the tacked structure at room temperature and with the pressure in chamber 56 at the high vacuum level, laser beam 60 is optionally scanned along the length of getter 50 to raise its temperature to a sufficient value to activate getter 50. The activation temperature is in the range of 300–950° C. More particularly, the activation temperature is 700–900° C., typically 800° C.

A single scan along the length of getter strip 50 is normally sufficient to activate all the gettering material of getter 50 as long as the diameter of laser beam 60 is at least the width of getter 50. If the diameter of beam 60 is so small compared to the width of getter strip 50 that some of the gettering material is likely not to be activated during a single laser scan, beam 60 can be scanned two or more times along different laterally separated paths that extend along the length of getter 50.

When laser 58 is operated in the preceding manner, each part of getter strip 50 is subjected directly to laser beam 60 only once. While the part of getter 50 immediately subjected to beam 60 is raised to a high temperature in activating that part of getter 50, the temperature of the activated part of getter 50 drops rapidly after beam 60 passes on. Consequently, only a small part of getter 50 is at a high temperature at any time. Secondary heating of components 40–46 by way of radiation from getter 50 is thus very small.

Using a heating element (not shown), the flat-panel display is raised to a bias temperature of 200–350° C., typically 300° C. The temperature ramp-up is usually performed in an approximately linear manner at a ramp-up rate in the vicinity of 3–5° C./min.

The components of the partially sealed flat-panel display outgas during the temperature ramp-up and during the subsequent "soak" time at the bias temperature prior to display sealing. The gases, typically undesirable, that were trapped in the display structure enter the unoccupied part of vacuum chamber 56, causing its pressure to rise slightly. To remove these gases from the enclosure that will be produced when baseplate structure 40 is fully sealed to composite structure 42/44/46/50/52, the vacuum pumping of chamber 56 is continued during the sealing operation in chamber 56. If activated, getter strip 50 assists in collecting undesired gases during the temperature ramp-up and subsequent soak.

Figure 4E:
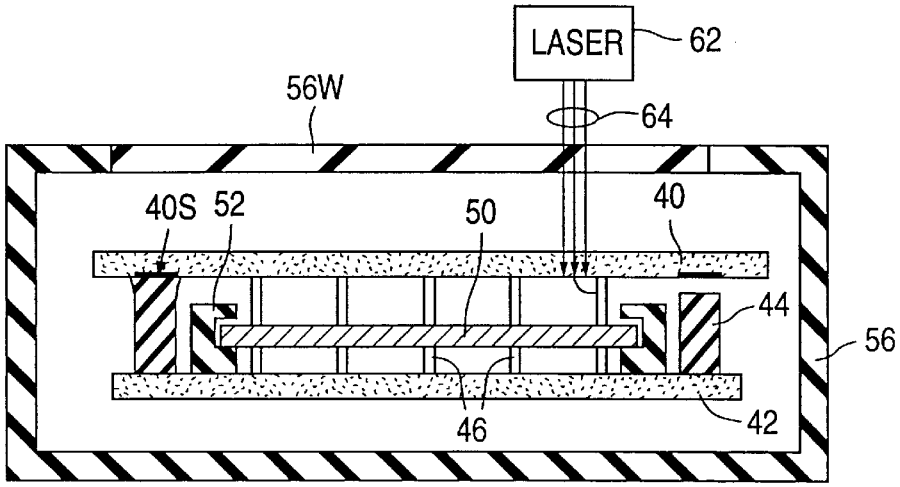

A laser 62 that produces a laser beam 64 is located outside vacuum chamber 56 as shown in FIG. 4*e*. Laser 62 may be the same as laser 58 depending on the factors such as the desired power level and beam diameter. Laser 62 is arranged so that beam 64 can pass through chamber window 56W and through transparent material of baseplate structure 40 along sealing area 40S.

With the pressure of vacuum chamber 54 at the high vacuum level and with the flat-panel display at the bias temperature, laser beam 64 is moved in such a way as to substantially fully traverse aligned sealing areas 40S and 44S. FIG. 4*e* illustrates how the flat-panel display appears at an intermediate point during the traversal of beam 64 along sealing areas 40S and 44S. If desired, beam 64 can skip tack portions 44A. As laser beam 64 traverses sealing areas 40S and 44S, light energy is transferred through baseplate structure 40 and locally to upper material of outer wall 44 along gap 54. The local energy transfer causes the material of outer wall 44 subjected to the light energy to melt and jump gap 54. The melted wall material along sealing area 44S hardens after beam 64 passes.

Getter strip 50 may be activated during the gap-jumping sealing operation using laser 58 in the manner described above. If getter 50 was activated prior to the final gap-jumping seal, this activation constitutes a re-activation. Also, if getter activation is performed during this step, laser 62 is normally a different laser from laser 58.

Gap 54 progressively closes during the sealing operation with laser 62. As gap 54 closes, the gases present in the enclosure being formed by the sealing of outer wall 44 to baseplate structure 40 escape from the enclosure through the progressively decreasing remainder of gap 54. Full closure of gap 54 occurs when beam 64 completes the rectangular traversal of sealing areas 40S and 44S.

Further contaminant gases are normally introduced into the unoccupied part of vacuum chamber 56 as a result of the display sealing process. Some of these gases will be present in the now-sealed compartment (cavity) formed by plate structures 40 and 42 and outer wall 44. Because the flat-panel display is sealed, the gases in sealed enclosure 40/42/44 cannot be removed by further vacuum pumping of chamber 56.

If getter strip 50 was activated prior to or/and during the final sealing operation (after pumping chamber 56 down to the desired vacuum level), getter 50 collected some of the gases present in sealed enclosure 40/42/44. However, in so doing, some of the gas-collection capability of getter 50 was used up.

Figure 4F:
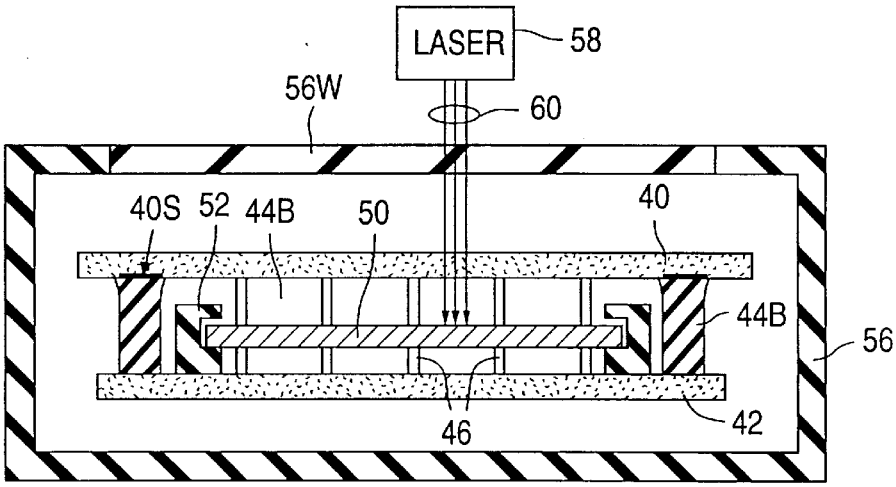

In any case, after completing the display sealing step and while the sealed flat-panel display is approximately at the bias temperature, laser 58 is normally employed to activate getter 50 in the manner described above. FIG. 4*f* illustrates the bias-temperature getter-activation step. If getter 50 was previously activated, this activation constitutes a re-activation.

The temperature of the sealed flat-panel display is subsequently returned to room temperature according to a cool-down thermal cycle that is controlled so as to avoid having the instantaneous cool-down rate exceed a selected value in the range of 3–5° C./min. The term "room temperature" here means the external (usually indoor) atmospheric temperature, typically in the vicinity of 20–25°C. Inasmuch as the natural cool-down rate at the beginning of the thermal cool-down cycle normally exceeds 3–5° C./min., heat is applied during the initial part of the cycle to maintain the cool-down rate at approximately the selected value in the range of 3–5° C./min. The heating is progressively decreased until a temperature is reached at which the natural cool-down rate is approximately the selected value, after which the flat-panel display is typically permitted to cool down naturally at a rate that progressively decreases to zero. Alternatively, a forced cool down can be employed during this part of the cool-down cycle to speed up the cool down.

Figure 4G:
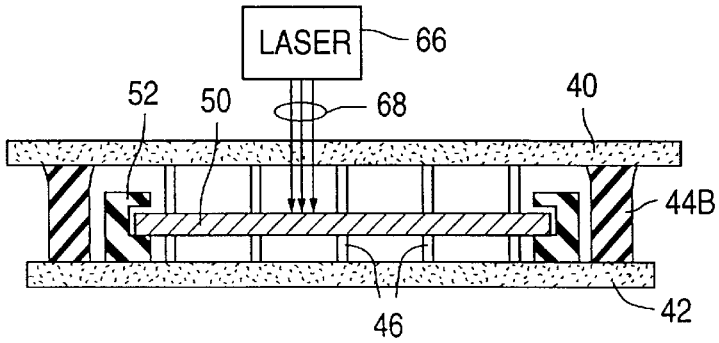

During the cool-down period, getter 50 can be activated/re-activated one or more times using laser 58 in the above-described manner to remove contaminant gases not previously collected and/or contaminant gases released during the sealing operation and cool down. The pressure in vacuum chamber 56 is subsequently raised to room pressure, and the fully sealed flat-panel display is removed from chamber 56. The term "room pressure" here means the external atmospheric pressure, normally in the vicinity of 1 atm. depending on the altitude. Alternatively, the chamber pressure can be raised to room pressure before cooling the sealed display down to room temperature. In either case, FIG. 4*g* illustrates the resulting structure. Item 44B in the sealed flat-panel display indicates the sealed shape of outer wall 44.

Part of the gettering-capability of getter strip 50 is used up in collecting gases present in enclosure 40/42/44 after it is sealed and the flat-panel display is brought down to room temperature. Accordingly, getter 50 is re-activated after the temperature ramp-down is completed and the sealed flat-panel display is approximately at room temperature. The re-activation is performed with a laser 66 having a laser beam 68 as indicated in FIG. 4*g*.

The getter re-activation can be performed while the sealed flat-panel display is in vacuum chamber 56 or after removing the display from chamber 56. If the getter re-activation is done while the flat-panel display is in chamber 56, laser 66 is normally the same as laser 58. In this case, the re-activation is performed in the manner described above for activating (or re-activating) getter 50.

If the post cool-down re-activation is done after removing the flat-panel display from vacuum chamber 56, laser 66 is normally a separate laser arranged so that laser beam 68 passes through transparent glass of baseplate structure 40 and impinges on getter 50. As with laser beam 60, laser beam 68 has a wavelength at which the glass strongly transmits light. No significant heating of any of components 40–46 occurs during the re-activation. When laser 66 is a separate laser from laser 58, the re-activation of laser 66 is performed in substantially the same way as, and at very similar conditions to, the activation/re-activation with laser 58.

Figure 4H:
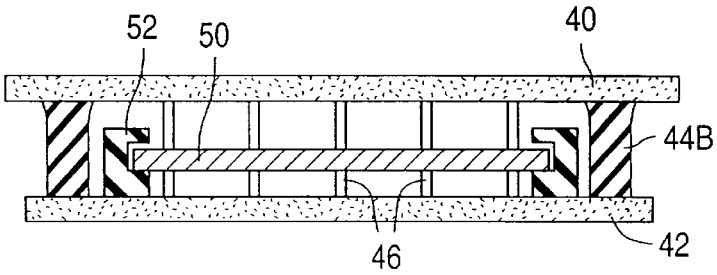

FIG. 4*h* illustrates how the flat-panel display appears after the post cool-down re-activation of getter 50 is complete. The sealed display with activated getter 50 is ready for the addition of external circuitry and/or incorporation into a television, video monitor, or other such image-presentation apparatus.

In the final flat-panel display of FIG. 4*h*, the combination of plate structures 40 and 42 and outer wall 44 forms a compartment (or chamber) that houses non-evaporable getter 50, including getter supports 52. Alternatively, a non-evaporable getter activated by a laser beam in accordance with the teachings of the invention can be situated in an auxiliary compartment that adjoins the main compartment formed with components 40–44. The getter-containing auxiliary compartment is typically connected to the main compartment by way of one or more openings through components 40–44 so that the two compartments reach substantially equal steady-state compartment pressures. Due to the random movement of gas molecules, gases present in the main compartment move into the auxiliary compartment and are sorbed by the getter.

Such a multi-compartment flat-panel display is preferably configured so that the getter-containing auxiliary chamber does not protrude so far from the main chamber as to require substantial additional handling care in order to avoid damaging the auxiliary compartment and destroying the display. In particular, the non-evaporable getter typically overlies, or largely overlies, the exterior surface of baseplate structure 40 and is housed in an auxiliary compartment which overlies part of the exterior surface of baseplate structure 40. The vertical dimension—i.e., the dimension in the direction perpendicular to the exterior surface of baseplate structure 40—of the auxiliary compartment is then preferably chosen so that it does not vertically extend significantly further away from baseplate structure 40 than circuitry, provided over the exterior surface of structure 40 to the side of the getter-containing auxiliary compartments, for controlling image-producing elements in the flat-panel display. Consequently, the presence of the auxiliary compartment does not significantly increase the amount of care that must be exerted in handling the display beyond the amount of handling care already needed due to the presence of the control circuitry.

With the getter being situated outside the main compartment in such a manner so as to overlie, or largely overlie, the main compartment, the getter does not cause the internal area of the main compartment to be significantly increased. Consequently, a flat-panel device arranged in this way has a high active-to-overall area ratio. Since the getter-containing auxiliary compartment is configured so as to not extend significantly further away from the main compartment than the control circuitry overlying the main compartment to the side of the auxiliary compartment, the overall thickness of the display depends on the thickness (or height) of the control circuitry. The presence of the auxiliary compartment does not lead to any significant increase in the overall thickness of a flat-panel display so configured.

Figure 7A:
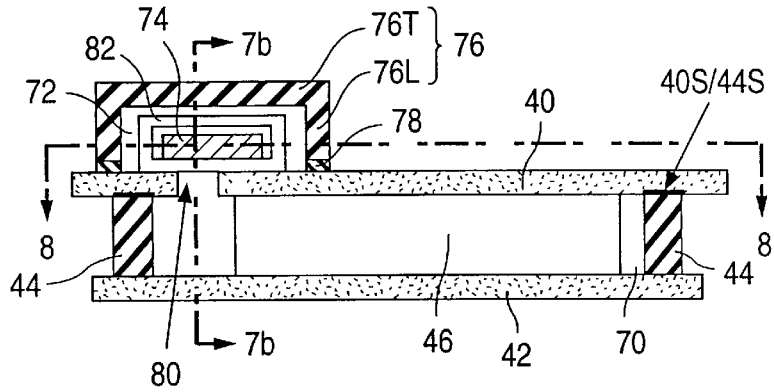
FIGS. 7*a* and 7*b* are cross-sectional side views of a flat-panel CRT display having a main compartment and a smaller auxiliary compartment that contains a non-evaporable getter suitable for being laser activated according to the invention. The cross section of FIG. 7*a* is taken through plane 7*a*—7*a* in FIG. 7*b*. The cross section of FIG. 7*b* is taken through plane 7*b*—7*b* in FIG. 7*a*.
Figure 7B:
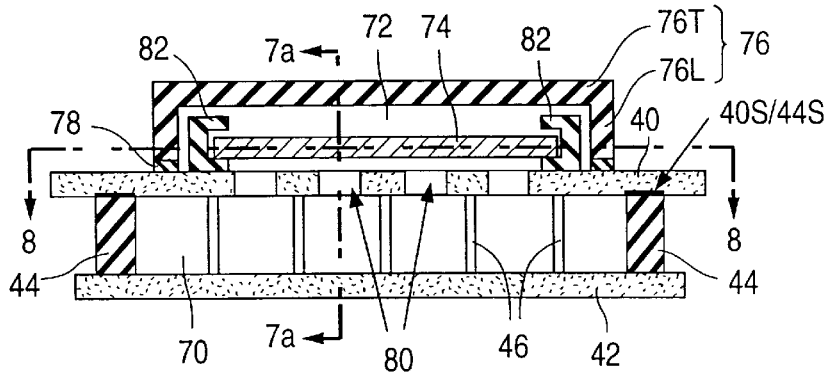
Figure 8:
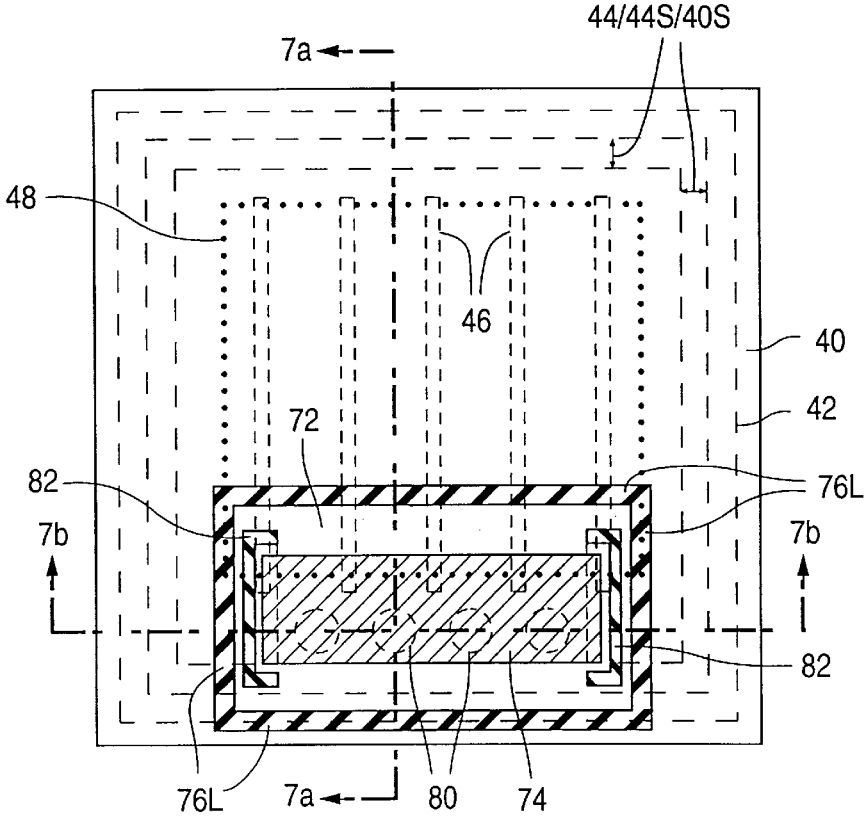
FIG. 8 is a cross-sectional plan view of the flat-panel CRT display in FIGS. 7*a* and 7*b*. The cross section of FIG. 8 is taken through plane 8—8 in FIGS. 7*a* and 7*b*. The cross sections of FIGS. 7*a* and 7*b* are taken respectively through planes 7*a*—7*a* and 7*b*—7*b* in FIG. 8.

FIGS. 7*a* and 7*b* (collectively "FIG. 7") illustrate an embodiment of such a two-compartment flat-panel display having a main compartment 70 and a smaller auxiliary compartment 72 that houses a non-evaporable getter strip 74 suitable for being laser activated according to the invention. FIG. 8 presents a top view of the flat-panel display in FIG. 7. The top view of FIG. 8 is taken through auxiliary compartment 72.

As indicated in FIG. 7, main compartment 70 is formed with plate structures 40 and 42 and outer wall 44. Baseplate structure 40 in FIG. 7 is provided with electron-emissive elements in the manner described above. Similarly, faceplate structure 42 is provided with light-emissive elements as described above. Spacer walls 46 are present in main compartment 70 and extend between plate structures 40 and 42 so as to maintain a constant spacing between structures 40 and 42 and provide strength to the display. Spacer walls 46 run generally perpendicular to the length of getter strip 74.

Auxiliary compartment 72 overlies main compartment 70 above part of the exterior surface of baseplate structure 40. Auxiliary compartment 72 is formed with baseplate structure 40 and a five-sided transparent auxiliary wall 76 consisting of a relatively flat rectangular top portion 76T and four relatively flat rectangular lateral portions 76L arranged in a rectangular annulus. Top auxiliary wall portion 76T extends generally parallel to baseplate structure 40. Lateral auxiliary wall portions 76L extend generally perpendicular to both top wall portion 76T and baseplate structure 40. The top edges of lateral wall portions 76L merge into the edges of top wall portion 76T. The bottom edges of lateral wall portions 76L are hermetically bonded to baseplate structure 40 along its exterior surface by way of sealing material 78, typically frit or indium.

Auxiliary wall 76 preferably consists of a unitary piece of glass. As such, auxiliary wall 76 is typically created by a molding, glass-blowing, etching or machining process. The corners of auxiliary wall 76 may be rounded. Alternatively, auxiliary wall portions 76L and 76T can be made separately and subsequently joined together.

Auxiliary compartment 72 is connected to main compartment 70 by way of a group of openings 80 extending through baseplate structure 40. FIGS. 7*b* and 8 illustrate four such inter-compartment openings 80.

As indicated in FIG. 8, openings 80 can be circular as viewed from the top.

Getter strip 74 is typically configured and constituted the same as getter strip 50 described above. A pair of getter supports 82 are located in auxiliary compartment 72 and are bonded to baseplate structure 40 along its exterior surface. Getter supports 82 thermally (and electrically) insulate getter 74 from auxiliary wall 76, baseplate structure 40, and the other components of the flat-panel display. Getter supports 82 are typically configured and constituted similar to getter supports 52 described above. The ends of getter strip 74 are situated in slot-shaped cavities located partway up the height of getter supports 82.

The flat-panel display of FIGS. 7 and 8 can be assembled in various ways. In a typically assembly sequence that begins with inter-compartment openings 80 provided through baseplate structure 40, plate structures 40 and 42 are hermetically sealed together through outer wall 44 according to a suitable technique. Getter structure 74/82 is then positioned appropriately over baseplate structure 40 after which getter supports 82 are bonded to structure 40 along its exterior surface. Auxiliary wall 76 is positioned over getter structure 74/82 and hermetically bonded to baseplate structure 40.

Instead of bonding getter supports 82 to baseplate structure 40, the flat-panel display of FIGS. 7 and 8 can be modified by bonding getter supports 82 to auxiliary wall 76, preferably the inside of top portion 76T. The combination of getter supports 82, getter strip 74, and auxiliary wall 76 can then be pre-fabricated as a unit to be later mounted over baseplate structure 40. Although inter-compartment openings 80 are typically provided through baseplate structure 40 before bonding auxiliary wall 76, by itself or as part of a pre-fabricated unit with getter structure 74/82, to baseplate structure 40, openings 80 can be created through structure 40 after bonding wall 76 to structure 40.

Getter strip 74 is activated with a laser beam in substantially the same manner as described above in connection with FIGS. 4*d*, 4*f*, and 4*g* except that the laser beam passes through transparent material of top auxiliary wall portion 76T rather than transparent material of baseplate structure 40. The pressure in auxiliary compartment 72 during the getter-activation step is at a high vacuum level no greater than $10^{-2}$ torr, typically $10^{-6}$ torr or less. The getter-activation temperature with the laser beam again is 300–950° C., preferably 700–900° C. As in the process of FIG. 4, very little heating of any of the display components, except for getter 74, occurs during the getter-activation process.

Figure 9A:
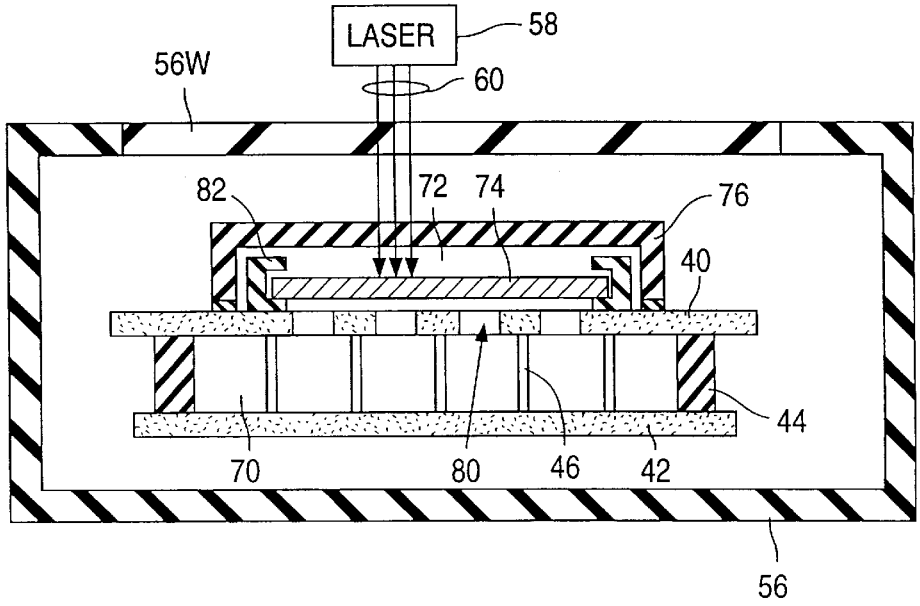
FIGS. 9*a* and 9*b* are cross-sectional side views, corresponding to the view of FIG. 7*b*, that depict laser activation of the getter in the flat-panel CRT display of FIGS. 7*a*, 7*b*, and 8 in accordance with the invention.

FIG. 9*a* depicts how getter strip 74 is activated with laser beam 60 produced by laser 58 while the flat-panel display of FIGS. 7 and 8 is in vacuum chamber 56.

Figure 9B:
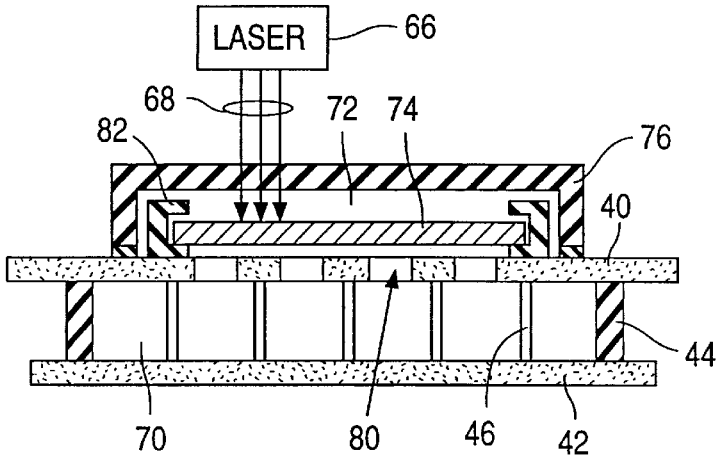

After the initial getter activation, one or more re-activation steps may be performed with the same laser or a different one. FIG. 9*b* depicts how getter 74 is activated/re-activated with laser beam 68 produced by laser 66 after the flat-panel display of FIGS. 7 and 8 is removed from vacuum chamber 56. Upon being activated/re-activated, getter 74 sorbs gases (i.e., gas molecules or atoms) that come in contact with getter 74, including gases produced during high-temperature operations by outgassing in compartments 70 and 72.

The laser-initiated gap jumping technique described above for the process of FIG. 4 can be employed in hermetically sealing plate structures 40 and 42 together through outer wall 44 in the flat-panel display of FIGS. 7 and 8. The sequence of getter activation, gap-jump sealing, and getter re-activation steps for the flat-panel display of FIGS. 7 and 8 is the same as that described above for the process of FIG. 4 except that directing a laser beam to produce gap jumping is not performed through any part of baseplate structure 40 covered by getter structure 74/82, and is typically not performed through any portion of baseplate structure 40 covered by auxiliary wall 76. The difficulty created by having getter structure 74/82 or auxiliary wall 76 cover area which is to be hermetically sealed by gap jumping, as occurs with part of aligned sealing areas 40S and 44S in the particular configuration of the flat-panel display shown in FIGS. 7 and 8, can be overcome by moving auxiliary compartment 72 slightly so that none of it overlies outer wall 44. Alternatively, gap jumping can be employed to seal faceplate structure 42 to outer wall 44 after sealing baseplate structure 40 to outer wall 44 and after bonding auxiliary wall 76 to baseplate structure 40.

Figure 10:
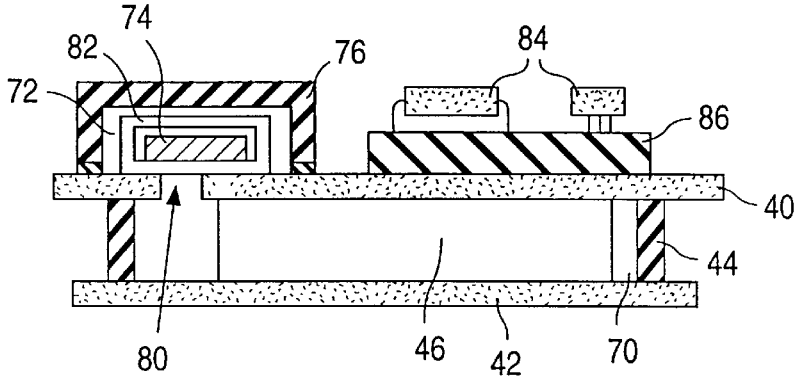
FIG. 10 is a cross-sectional side view, corresponding to the view of FIG. 7*a*, that depicts control circuitry provided on the display of FIGS. 7*a*, 7*b*, and 8.

Control circuitry is normally provided on the exterior surface of baseplate structure 40 to the side of auxiliary compartment 72 as shown in FIG. 10. The control circuitry typically consists of circuitry elements 84 interconnected by way of electrically conductive traces (not shown) provided on a printed circuit board 86 attached to baseplate structure 40. In order to minimize high temperatures that control circuitry 84/86 could be subjected to during sealing and bonding operations, control circuitry 84/86 is normally mounted on the flat-panel display after sealing plate structures 40 and 42 to outer wall 44 and after bonding auxiliary wall 76 to baseplate structure 40. FIG. 10 illustrates that auxiliary wall 76 extends to roughly the same height above baseplate structure 40 as control circuitry 84/86. In any case, auxiliary wall 76 does not extend significantly further above baseplate structure 40 than control circuitry 84/86.

Figure 11A:
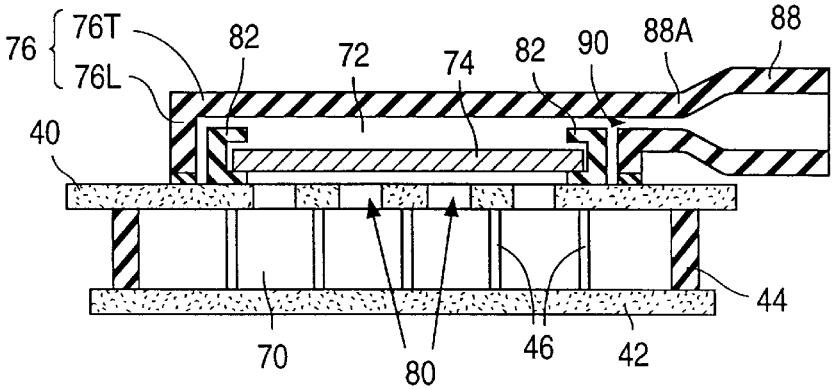
FIGS. 11*a* and 11*b* are cross-sectional side views, corresponding to the view of FIG. 7*b*, that depict how the display of FIGS. 7*a*, 7*b*, and 8 appears respectively before and after closure of pump-out tubulation provided on the display according to the invention.

Instead of hermetically sealing the flat-panel display of FIGS. 7 and 8 by a process that involves laser-initiated gap jumping at in a high vacuum environment, the hermetic sealing of plate structures 40 and 42 together through outer wall 44 can be performed at a pressure close to room pressure in a suitable neutral (i.e., non-reactive) environment, after which the pressure in the sealed display is reduced to a high vacuum level by pumping gas out of the display through a suitable port provided on the display, preferably a pump-out port that does not protrude out awkwardly from the display. FIG. 11*a* presents a variation of the flat-panel display of FIGS. 7 and 8 in which a glass pump-out tube 88 is connected to auxiliary compartment 72 through an opening 90 in one of lateral auxiliary wall portions 76L to form a port for evacuating the display in accordance with the invention. Pump-out tube 88 extends laterally over a part of baseplate structure 40 not covered by control circuitry 84/86.

Pump-out tube 88 has a constricted portion 88A close to the location at which tube 88 meets one of lateral auxiliary wall portions 76L. Constricted tube portion 88A is employed for closing pump-out port 88 by heating portion 88A with a suitable heating element situated close to portion 88 A after the display has been pumped out through part 88 to a high vacuum level no greater than $10^{-2}$ torr, again typically $10^{-6}$ torr or less. The pressure differential across constricted tube portion 88A (i.e., the difference between the high outside pressure in the neutral environment and the very low pressure in the pumped-down display) causes portion 88A to collapse and become closed when it is suitably heated. The heating to close tube portion 88A could also be performed with a laser.

As indicated in FIG. 11*a*, pump-out tube 88 extends laterally away from auxiliary compartment 72 and thus does not overlie compartment 72. Consequently, the heating of constricted portion 88A to close tube 88 is not likely to result in heat transfer that could generate significant stress in auxiliary wall 76 and thereby create weak points in the flat-panel display.

Figure 11B:
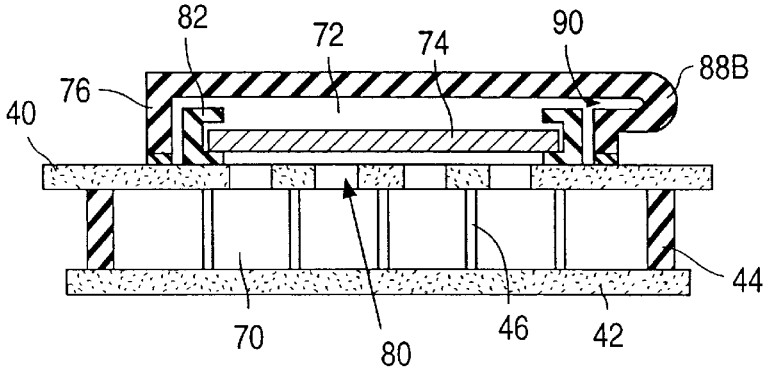

FIG. 11*b* depicts how the flat-panel display of FIG. 11*a* appears after pump-out port 88 is closed. Item 88B in FIG. 11*b* is the closed remainder of the pump-out tube 88. Inasmuch as closed pump-out portion 88B extends laterally away from auxiliary compartment 72, closed portion 88B does not extend significantly higher above baseplate structure 40 than auxiliary wall 76. Furthermore, closed pump-out portion 88B normally does not extend laterally beyond the outer perimeter of baseplate structure 40. As a result, the incorporation of closed pump-out portion 88B into the sealed flat-panel display does not necessitate any significant amount of additional handling care to avoid damaging the display.

Hermetic room-pressure sealing of plate structures 40 and 42 together through outer wall 44 in a neutral environment, typically dry nitrogen or an inert gas such as argon, at approximately room pressure is performed at an elevated sealing temperature, typically 300° C., for the flat-panel display of FIG. 11*a*. The hermetic bonding of auxiliary wall 76 to baseplate structure 40, which can be done at various times relative to the steps involved in hermetically sealing plate structures 40 and 42 and outer wall 44, is likewise performed in a neutral environment, again typically dry nitrogen or an inert gas such as argon, at approximately room pressure and at elevated temperature.

After these sealing and bonding operations are complete, a bake operation is normally performed on the flat-panel display of FIG. 11*a* in order to outgas further gases, such as gases released during the sealing and bonding operations, that might cause damage to the display during normal operation. The bake is typically done for 1–2 hrs. at 150–300° C., typically 200° C.

The display of FIG. 11*a* is subsequently evacuated with a suitable vacuum pump (not shown) connected directly to pump-out port 88. When the requisite vacuum level is reached, pump-out tube 88 is thermally closed at constricted portion 88A to produce the sealed display of FIG. 11*b*. The display evacuation and tube closure steps are typically performed after the display is cooled to room temperature, but can be done while the display is at the bake temperature or during cool down.

Non-evaporable getter 74 is laser activated after pump-out port 88 is closed. At the minimum, activation of getter 74 with laser beam 68 of FIG. 9*b* is performed after the flat-panel display is cooled to room temperature. If pump-out port 88 is closed while the display is at elevated temperature, getter 74 can be activated with laser beam 60 or 68 of FIG. 9*a* or 9*b* one or more times during the period that the display is at elevated temperature and/or is being cooled down to room temperature. The getter activation after cool down is then a re-activation.

Figure 12A:
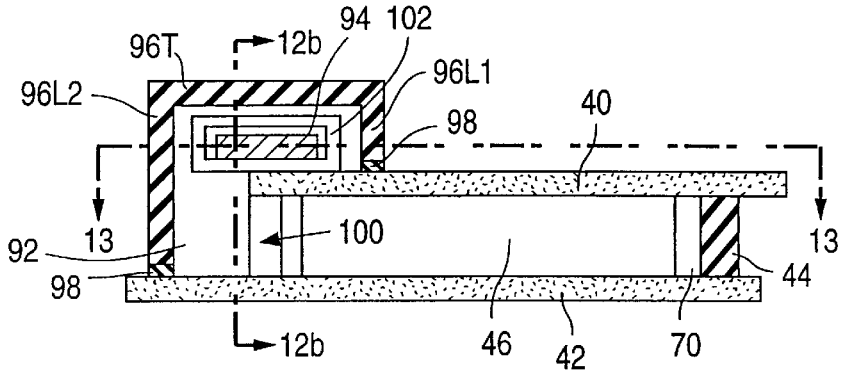
FIGS. 12*a* and 12*b* are cross-sectional side views of a flat-panel CRT display configured in accordance with the invention so as to have a main compartment and a smaller auxiliary compartment that contains a getter suitable for being laser activated according to the invention. The cross section of FIG. 12*a* is taken through plane 12*a*—12*a* in FIG. 12*b*. The cross section of FIG. 12*b* is taken through plane 12*b*—12*b* in FIG. 12*a*.
Figure 12B:
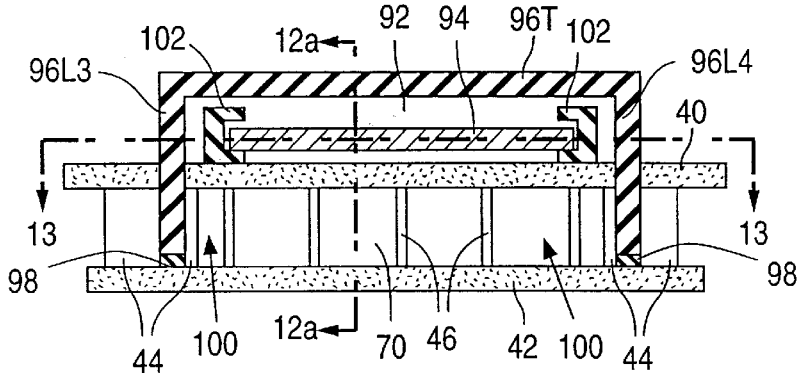
Figure 13:
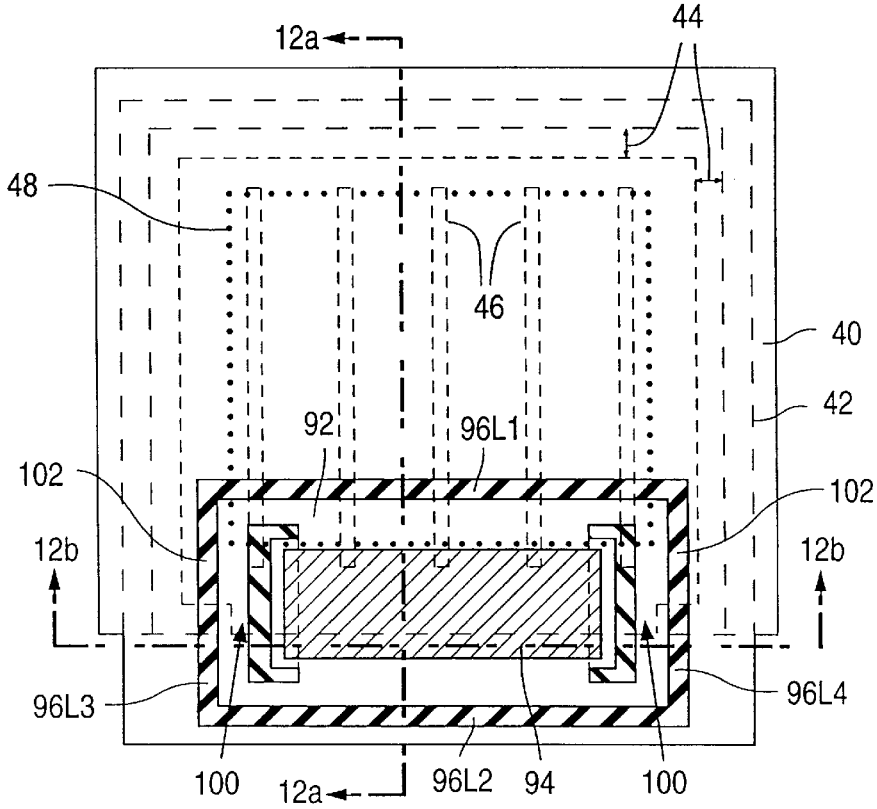
FIG. 13 is a cross-sectional plan view of the flat-panel CRT display of FIGS. 12*a* and 12*b*. The cross section of FIG. 13 is taken through plane 13—13 in FIGS. 12*a* and 12*b*. The cross sections of FIGS. 12*a* and 12*b* are taken respectively through planes 12*a*—12*a* and 12*b*—12*b* in FIG. 13.

FIGS. 12*a* and 12*b* (collectively "FIG. 12") illustrate, in accordance with the invention, an embodiment of a two-compartment flat-panel display having an auxiliary compartment 92 that houses a non-evaporable getter strip 94 suitable for being laser activated according to the invention. Getter strip 92, situated outside main compartment 70 in the two-compartment flat-panel display of FIG. 12, is of somewhat more complex shape than auxiliary compartment 72 in display of FIGS. 7 and 8 but avoids any loss of strength due to openings through baseplate structure 40. Aside from this difference, the two-compartment display of FIGS. 12 and 13 achieves substantially all the advantages of the two-compartment display of FIGS. 7 and 8, particularly a high active-to-overall area ratio. FIG. 13 presents a top view of the flat-panel display in FIG. 12. The top view of FIG. 13 is taken through a portion of auxiliary compartment 92 above baseplate structure 40.

Main compartment 70 in the flat-panel display of FIGS. 12 and 13 is formed with plate structures 40 and 42 and outer wall 44 in the same manner as in the display of FIGS. 7 and 8. However, baseplate structure 40 is slightly shorter at the left-hand edge in the display of FIGS. 12 and 13, while faceplate structure 42 is slightly longer at the left-hand edge in the display of FIGS. 12 and 13. Plate structures 40 and 42 in the display of FIGS. 12 and 13 respectively contain electron-emissive elements and light-emissive elements as described above. Spacer walls 46 run perpendicular to the length of getter strip 94.

Auxiliary compartment 92 overlies larger main compartment 70 above part of the exterior surface of baseplate structure 40 and extends beyond main compartment 70 so as to overlie a portion of the interior surface of faceplate structure 42. Auxiliary compartment 92 is formed with baseplate structure 40, faceplate structure 42, and a five-sided transparent auxiliary wall consisting of a relatively flat rectangular top portion 96 T and four relatively flat lateral portions 96L1, 96L2, 96L3, and 96L4 (collectively "96L") arranged in a rectangular annulus. Top auxiliary wall portion 96T extends generally parallel to baseplate structure 40. Lateral auxiliary wall portions 96L extend generally perpendicular to top wall portion 96T and plate structures 40 and 42. The top edges of lateral wall portions 96L merge into top wall portion 96T.

Opposing lateral auxiliary wall portions 96L1 and 96L2 are rectangular in shape. The bottom edge of lateral wall portion 96L1 is hermetically bonded to baseplate structure 40 along its exterior surface. The bottom edge of lateral wall portion 96L2 is hermetically bonded to faceplate structure 42 along its interior surface at a location not overlapped by baseplate structure 40.

Each of opposing lateral auxiliary wall portions 96L3 and 96L4 is in the shape of a rectangle with a rectangular portion of one corner removed. The bottom edge of each of lateral wall portions 96L3 and 96L4 has an upper edge portion, a side edge portion, and a lower edge portion respectively bonded to the exterior surface of baseplate structure 40, the outside surface of outer wall 44, and the interior surface of faceplate structure 42. The bonding of auxiliary lateral wall portions 96L to components 40–44 is done with sealing material 98, typically frit.

Auxiliary wall portions 96L and 96T (collectively "96") typically consist of a unitary piece of glass. As with auxiliary wall 76, auxiliary wall 96 is normally created by a molding, glass-blowing, etching, or machining process. Likewise, the corners of auxiliary wall 96 may be rounded. Alternatively, auxiliary wall portions 96L and 96T can be made separately and subsequently joined together.

Figure 14A:
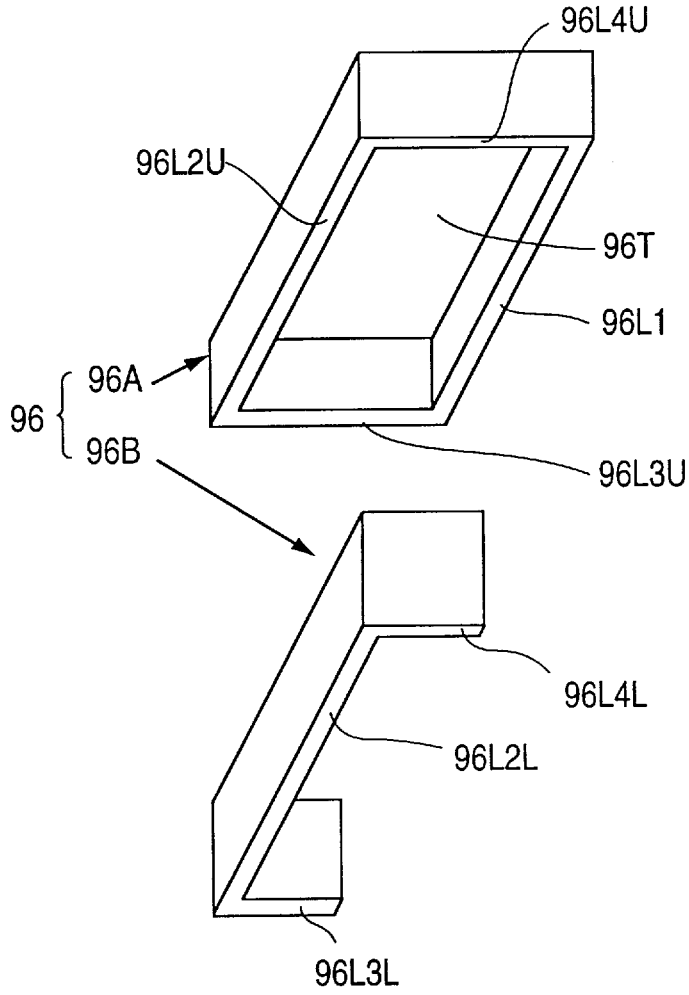
FIGS. 14*a* and 14*b* are perspective views that depict the assembly of a two-part implementation, in accordance with the invention, of the auxiliary wall of the auxiliary compartment in the flat-panel display of FIGS. 12*a*, 12*b*, and 13.
Figure 14B:
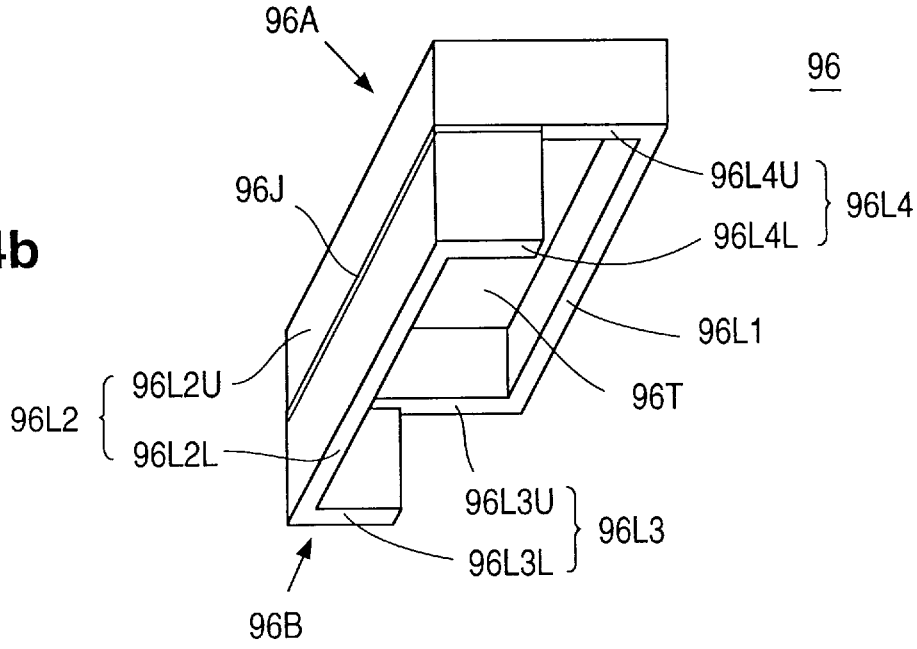

FIGS. 14*a* and 14*b* (collectively "FIG. 14") illustrate a method of fabricating auxiliary wall 96 as a two-part component. As shown in FIG. 14*a*, the two components of auxiliary wall 96 are a five-sided upper wall section 96A and a three-sided lower wall section 96B. Upper auxiliary wall section 96A consists of top wall portion 96T that merges into an annular four-sided wall portion consisting of equal-height wall portions 96L1, 96L2U, 96L3U and 96L4U whose composite upper edge merges into the perimeter edge of top wall portion 96T. Lower auxiliary wall section 96B consists of equal-height wall portions 96L2L, 96L3L, and 96L4L that form a partially annular wall. Each of wall sections 96A and 96B in FIG. 14*a* is typically formed by molding, glass blowing, etching, or machining.

The lower edge of upper wall section 96A is joined to the upper edge of lower wall section 96B by bonding material 96J as depicted in FIG. 14*b*. The bonding step is performed in such a way that wall portions 96L2U and 96L2L are joined together to form wall portion 96L2, wall portions 96L3U and 96L3L are joined together to form wall portion 96L3, and wall portions 96L4U and 96L4L are joined together to form wall portion 96L4. Although fabrication of auxiliary compartment 92 in the manner shown in FIG. 14 requires that the flat-panel display of FIGS. 12 and 13 have an extra seal (bonding material 96J), assembling auxiliary wall 96 from wall sections 96A and 96B in the indicated way facilitates manufacture of wall 96.

Auxiliary compartment 92 is connected to main compartment 70 by way of one or more openings 100 through one sub-wall of outer wall 44. One such inter-compartment opening 100 is depicted in FIGS. 12 and 13. Inter-compartment opening 100 in FIGS. 12 and 13 extends the full height of outer wall 44 and thereby forms a gap in otherwise annular wall 44. By interconnecting compartments 70 and 92 by way of one or more openings through outer wall 44, there is no need to interconnect compartments 70 and 92 by way of one or more openings through baseplate structure 40. Weak points that might arise in a flat-panel display due to the presence of openings through baseplate structure 40 are avoided in the display of FIGS. 12 and 13.

As with getter strip 74 in the display of FIGS. 7 and 8, getter strip 94 is typically configured and constituted the same as getter strip 50 described above. A pair of getter supports 102 are located in auxiliary compartment 92 above baseplate structure 40 and are bonded to structure 40 along its exterior surface. Getter supports 102 may extend laterally slightly beyond the perimeter of baseplate structure 40 as depicted in the example of FIG. 12*a*. Getter supports 102 thermally (and electrically) insulate getter 90 from auxiliary wall 92, plate structures 40 and 42, and the other display components. As with getter supports 82 in the display of FIGS. 7 and 8, getter supports 102 are typically configured and constituted similar to getter supports 52. The ends of getter strip 94 are situated in slots located partway up getter supports 102. Getter 94 is thus spaced apart from plate structures 40 and 42 and walls 44 and 96.

The flat-panel display of FIGS. 12 and 13 can be assembled in various ways, typically in a similar manner to the display of FIGS. 7 and 8. In one assembly sequence that begins with inter-compartment opening 100 present in outer wall 44, plate structures 40 and 42 are hermetically sealed together through outer wall 44 according to a suitable technique. The laser-initiated gap jumping technique described above can be utilized in the hermetic sealing of components 40–44. Getter structure 94/102 is positioned over baseplate structure 40 after which getter supports 102 are bonded to structure 40. Finally, auxiliary wall 96 is positioned over getter structure 94/102 and is hermetically bonded to plate structures 40 and 42.

Similar to what is done in the flat-panel display of FIGS. 7 and 8, the flat-panel display of FIGS. 12 and 13 can be modified by bonding getter supports 102 to auxiliary chamber 96, likewise preferably the inside of top wall portion 96T, rather than to baseplate structure 40. The combination of getter supports 82, getter 94, and auxiliary wall 96 can then be pre-fabricated as a unit to be mounted on baseplate structure 40.

Getter strip 94 is activated with a laser beam in way described above for getter strip 74 in the display of FIGS. 7 and 8, and thus in substantially the same manner described above in connection with FIGS. 4*d*, 4*f*, and 4*g* except that the laser beam passes through transparent material of top auxiliary wall portion 96T rather than through baseplate structure 40. The temperature and pressure parameters for activating getter 94 with the laser beam are the same as for laser activating getter 74. When gap jumping is employed in hermetically sealing the flat-panel display of FIGS. 12 and 13, the gap jumping is typically modified in the way described above for the display of FIGS. 7 and 8. That is, gap jumping is typically performed along the faceplate-structure-to-outer-wall interface rather than the baseplate-structure-to-outer-wall interface.

Figure 15A:
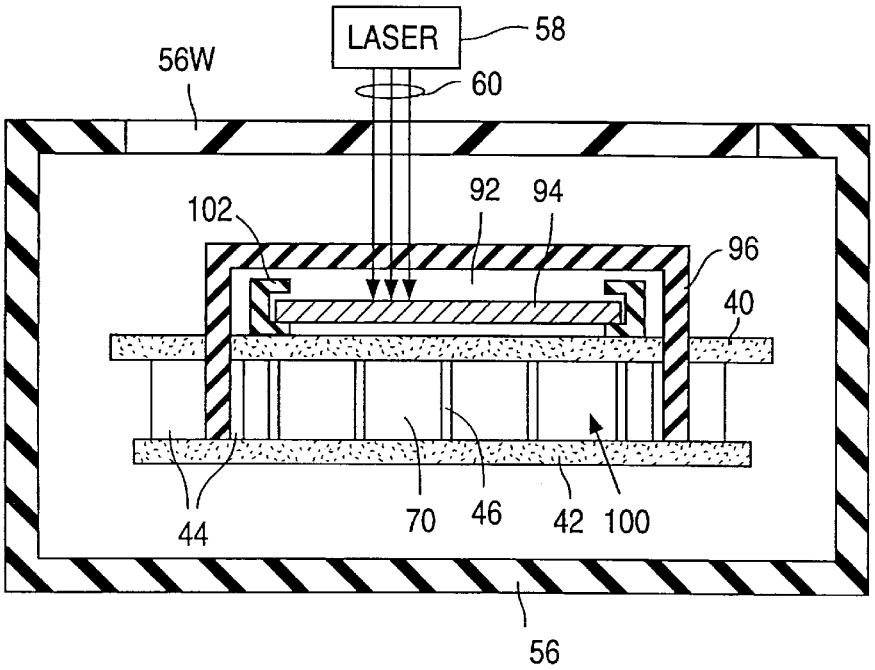
FIGS. 15*a* and 15*b* are cross-sectional side views, corresponding to the view of FIG. 12*b*, that depict laser activation of the getter in the flat-panel CRT display of FIGS. 12*a*, 12*b*, and 13 in accordance with the invention.
Figure 15B:
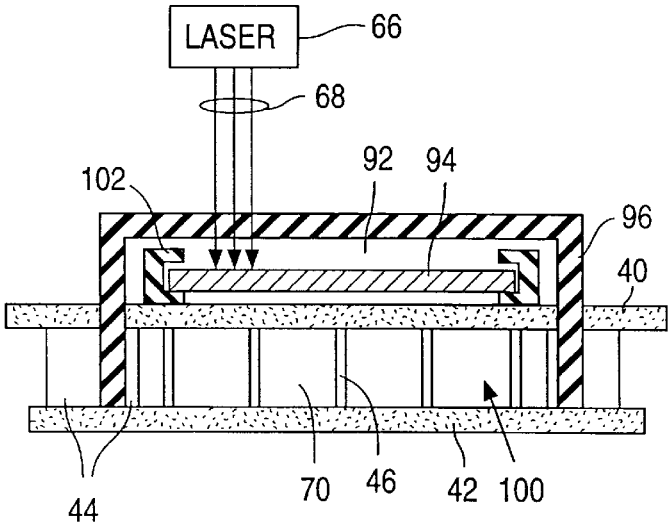

FIG. 15*a* depicts how getter strip 94 is activated with laser beam 60 when the flat-panel display of FIGS. 12 and 13 is in vacuum chamber 56. After initially activating getter 94, one or more re-activation steps may be performed with the same laser or a different one. FIG. 15*b* depicts how getter strip 94 is activated/re-activated with laser beam 68 after the display of FIGS. 12 and 13 is removed from chamber 56. Upon being activated/re-activated, getter 94 sorbs gases that come into contact with getter 94, including gases produced during high-temperature operations by outgassing in compartments 70 and 92.

Figure 16:
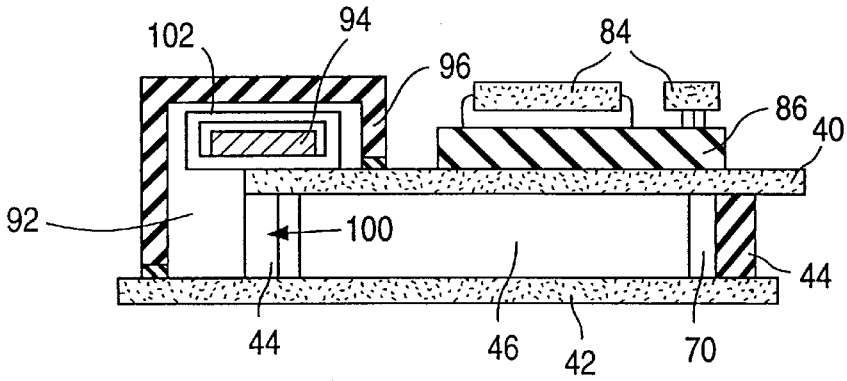
FIG. 16 is a cross-sectional side view, corresponding to the view of FIG. 12*a*, that depicts control circuitry provided on the display of FIGS. 12*a*, 12*b*, and 13 in accordance with the invention.

Control circuitry, again consisting of circuitry elements 84 interconnected by way of electrically conductive traces on printed circuit board 86 attached to the exterior surface of baseplate structure 40, is provided on the flat-panel display of FIGS. 12 and 13 to the side of auxiliary compartment 92 as shown in FIG. 16. To avoid subjecting control circuitry 84/86 to the high temperatures involved in sealing/bonding components 40–46, and 96 together, control circuitry 84/86 is normally mounted on the display after sealing plate structures 40 and 42 to outer wall 44 and after bonding auxiliary wall 96 to components 40–44. Auxiliary wall 96 typically extends to roughly the same height above baseplate structure 40 as control circuitry 84/86 and, in any event, does not extend significantly further above structure 40 than control circuitry 84/86.

Figure 17A:
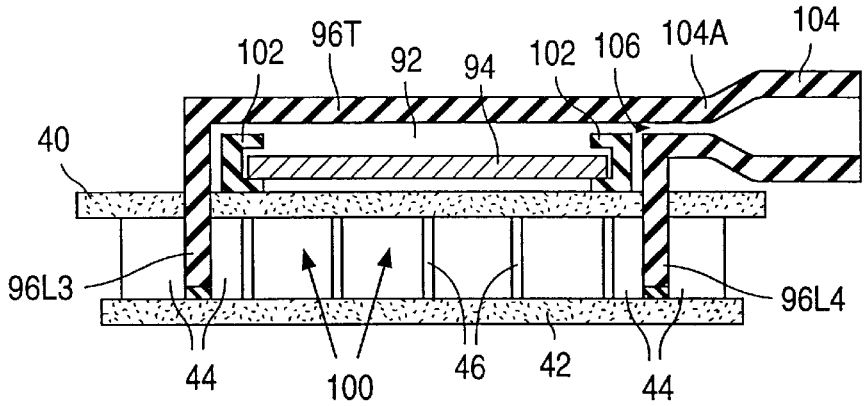
FIGS. 17*a* and 17*b* are cross-sectional side views, corresponding to the view of FIG. 12*b*, that depict how the display of FIGS. 12*a*, 12*b*, and 13 appears respectively before and after closure of pump-out tubulation provided on the display according to the invention.

Similar to the display of FIGS. 7 and 8, the hermetic sealing of plate structures 40 and 42 together through outer wall 44 in the of FIGS. 12 and 13 can be done at a pressure close to room pressure in a suitable neutral (again, non-reactive) environment after which the display is internally pumped down to a vacuum pressure level through a suitable port provided on the display, likewise preferably a pump-out port that does not protrude out awkwardly so as to create significant display handling problems. FIG. 17*a* presents a variation of the flat-panel display of FIGS. 12 and 12 in which a glass pump-out tube 104 is connected to auxiliary compartment 92 through an opening 106 in lateral auxiliary wall portion 96L4 to form a port for evacuating the display in accordance with the invention. As with pump-out tube 88 applied in FIG. 11*a* to the display of FIGS. 7 and 8, pump-out tube 104 applied in FIG. 17*a* to the display FIGS. 12 and 13 extends laterally over part of baseplate structure 40 not covered by control circuitry 84/86.

Pump-out port 104 has a constricted portion 104A close to where port 104 meets lateral wall portion 96L4. Constricted port portion 104A is utilized for closing port 104 by heating constricted portion 104A with an appropriate heating element situated close to portion 104A. A laser could also be used to close tube 104 at portion 104A. Similar to what occurs with pump-out tube 88 in FIG. 11*a*, FIG. 17*a* shows that pump-out tube 104 extends laterally away from auxiliary compartment 92 and thus does not overlie compartment 92. Accordingly, heat transfer that could generate significant stresses in auxiliary wall 96 and create weak points in the display is not likely to occur from the heating of constricted portion 104A to close port 104.

Figure 17B:
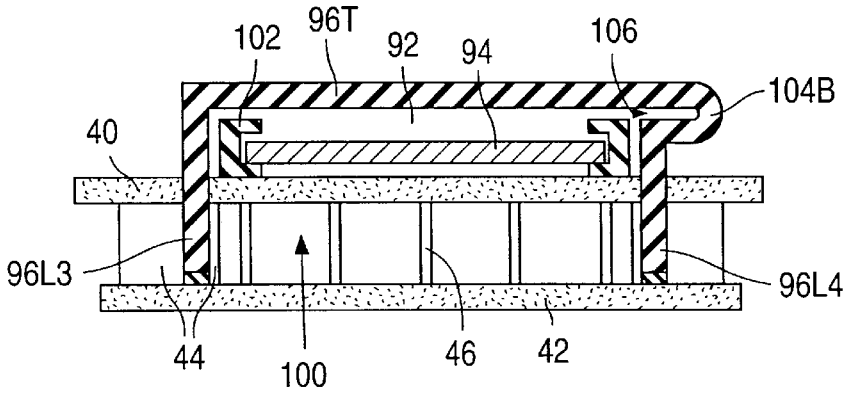

FIG. 17*b* illustrates the flat-panel display of FIG. 17*a* after port closure. Item 104B in FIG. 17*b* is the closed remainder of pump-out port 104. Closed pump-out portion 104B does not extend significantly higher above baseplate structure 40 than auxiliary wall 96. Nor does pump-out tube remainder 104B normally extend laterally beyond the perimeter of baseplate structure 40. The incorporation of remaining pump-out portion 104S into the sealed flat-panel display of FIGS. 12 and 13 therefore does not significantly increase the degree of handling care that must be employed to avoid damaging the display.

The hermetic sealing of the display of FIG. 17*a* in a neutral environment approximately at room-pressure is performed in the way described above for the display of FIG. 11*a*. The same applies to the auxiliary-compartment bonding operation. When these operations are completed, the display of FIG. 17*a* is baked as described above for the display of FIG. 11*a* and then evacuated after which pump-out port 104 is closed at constricted portion 104A to produce the sealed display of FIG. 17*b*. The laser activation/re-activation of getter 94 in the display of FIG. 17*b* after port closure is performed at the same stages that getter 74 is activated in the sealed display of FIG. 11*a*.

FIGS. 18*a* and 18*b* (collectively "FIG. 18") illustrate, in accordance with the invention, an embodiment of a two-compartment flat-panel display having an annular outer wall 110 through which a cavity partially extends to form an auxiliary compartment 112 next to main compartment 70. Auxiliary compartment 112 houses a non-evaporable getter 114 suitable for being laser activated according to the invention. Main compartment 70, which again contains spacer walls 46, is here formed with baseplate structure 40, faceplate structure 42, and intervening outer wall 110. FIG. 19 presents a perspective view of a portion of outer wall 110 having auxiliary compartment 112.

Outer wall 110 consists of a (relatively) tall portion 110A, a short upper portion 110B, a short intermediate portion 110C, and a short lower portion 110D. Tall outer-wall portion 110A occupies three sides of the outer wall perimeter and contacts both of plate structures 40 and 42. Short outer-wall portions 110B and 110D are rectangular layers that respectively contact plate structures 40 and 42 along the fourth side of the outer wall perimeter. Outer-wall portions 110A, 110B, and 110D typically consist of frit. Portions 110B and 110D could also be formed with epoxy. The material of outer-wall portion 110B is normally transparent to light in certain wavelength bands.

Short intermediate outer-wall portion 110C is a hollow five-sided transparent structure having a top side, a bottom side, a pair of opposing lateral sides (or ends) that merge with the top and bottom sides, and a central third lateral side that merges with the other four sides. The top and bottom sides of intermediate portion 110C respectively contact upper outer-wall portion 110B and lower outer-wall portion 110D. The ends of intermediate portion 110C contact the insides of the ends of tall lateral-wall portion 110A. The ends of portion 110C can be eliminated if the remainder of portion 110C is strong enough to maintain the requisite spacing between plate structures 40 and 42 along portion 110C. The hollow part of intermediate portion 110C forms the cavity of auxiliary compartment 112. Intermediate portion 110C consists of transparent material, typically a unitary piece of glass formed by a molding, glass-blowing, etching, or machining process.

Getter strip 114 is typically configured and constituted the same as getter strip 50. A pair of getter supports 116 situated in auxiliary compartment 112 thermally (and electrically) insulate getter 114 from intermediate outer-wall portion 110C and the other components of the flat-panel display. Getter supports 116 are bonded to the top of the lower side of intermediate portion 110C. Getter supports 116 are typically configured and constituted the same as getter supports 52. The ends of getter strip 114 are situated in-slots partway up getter supports 116 so that getter 114 is spaced apart from intermediate portion 110C and the other display components.

Assembly of the flat-panel display in FIGS. 18 and 19 is initiated by inserting getter structure 114/116 into auxiliary compartment 112, bonding getter supports 116 to the top of intermediate outer-wall portion 110C, placing outer-wall portions 110B and 110D respectively over the top and bottom sides of intermediate portion 110C, and placing composite wall structure 110B/110C/110D between the sides of the ends of three-sided tall outer-wall portion 110A situated on one of plate structures 40 and 42, typically baseplate structure 40. These initial steps can be performed in various orders. After completing the initial assembly steps, plate structures 40 and 42 are hermetically sealed together through outer wall 110, during which intermediate portion 110C becomes hermetically sealed to outer-wall portions 110B and 110D.

Laser-initiated gap jumping can be employed in hermetically sealing plate structures 40 and 42 together through outer wall 110 in substantially the same way as described above for the process of FIG. 4. Getter 114 is then typically activated/re-activated during the hermetic sealing process at the same stages as in the process of FIG. 4. The only notable difference is that, instead of having the laser beam pass through a transparent generally central portion of baseplate structure 40, the laser beam passes either from the side through the central side of intermediate outer-wall portion 110C or from the top through a transparent portion of baseplate structure 40 near its perimeter, through short upper outer-wall portion 110B, and then through the top side of intermediate outer-wall portion 110C. When the laser beam passes through the side of intermediate outer-wall portion 110C, getter strip 114 is typically slanted to facilitate local heat transfer from the laser beam to getter 114.

Subject to the difference in how the laser beam enters the flat-panel display to activate getter 114 and to the fact that the display of FIGS. 18 and 19 is a two-compartment structure rather than the one-compartment structure of FIG. 4, the views shown in FIGS. 4*f* and 4*g* closely represent how getter 114 is laser activated before and after removal of the display from vacuum chamber 56, with getter 114 being substituted for getter 50 in FIGS. 4*f* and 4*g*. During the laser activation/re-activation of getter 114, very little heat is transferred to any of the display components other than getter 114.

Alternatively, the flat-panel display of FIGS. 18 and 19 can be provided with a pump-out port (not shown). Hermetic sealing of plate structures 40 and 42 together through outer wall 110 is then performed at approximately room pressure in a suitable neutral environment, again typically dry nitrogen or argon. The display is subsequently pumped down to a vacuum pressure level through the pump-out port, and the port is closed. Getter 114 is now laser activated at least once in the manner described above. Laser activation of getter 114 is, at the minimum, performed after cooling the display down to room temperature. Laser activation of getter 114 can be performed while the display is at the sealing temperature and/or during cool down.

While the invention has been described with reference to particular embodiments, this description is solely for the purpose of illustration and is not to be construed as limiting the scope of the invention claimed below. For example, a getter akin to getter strip 74, 94, or 114 can be situated in an auxiliary compartment of a reduced-pressure flat-panel device such as a plasma display or a plasma-addressed liquid-crystal display having a main compartment in which a plasma is formed during display operation. The auxiliary and main compartments are connected together so that the pressures in the two compartments substantially reach a common pressure between room pressure and a high vacuum due to the presence of inert gas in the two compartments. The inert gas is typically xenon, neon, helium, krypton, or/and argon. The pressure in the auxiliary and main compartments of the reduced-pressure device is at least 1 torr, typically 5 torr to 0.5 atm.

The getter situated in the auxiliary compartment of the reduced-pressure device is laser activated in the manner described above. The getter sorbs non-inert gases in the compartments but does not sorb inert gases. Consequently, the presence of the inert gas in the compartments does not cause a significant part of the gettering capability to be expended. The plasma which is created in the main compartment and whose ions invariably enter the auxiliary compartment is created from the inert gas. The getter likewise does not collect ions of the inert gas.

Outer wall 44 can be formed with a rectangular annular non-frit portion sandwiched between a pair of rectangular annular frit layers. Non-evaporable getter strips 50, 74, 94, and 114 can be formed with materials other than a porous combination of titanium and a vanadium-containing alloy. Each of getters 50, 74, 94, and 114 can have shapes other than a strip.

Getter supports 52, 82, 102, and 116 likewise can have different shapes than described above, providing that they thermally (and electrically) insulate getters 50, 74, 94, and 114 from the other display components. Getter supports 116 can be bonded to the top or central portion of intermediate outer-wall portion 110C, rather than to the bottom of intermediate outer-wall portion 110C, prior to the alignment and sealing steps. If getter 74, 94, or 114 is likely to bend and touch an undesired surface, one or more additional getter supports can be provided along the length of getter 74, 94, or 114 to resist such bending.

Getter 74 can be replaced with two or more getters situated in auxiliary compartment 72. In like manner, getter 94 can be replaced with two or more getters situated in auxiliary compartment 92. Multiple getters can be situated in multiple auxiliary compartments located outside main compartment 70.

Each of two or more of the sub-walls of outer wall 110 in the display of FIGS. 18 and 19 can be provided with getter 114, along with getter supports 116. If the opposing lateral sides of intermediate outer-wall portion 110C are not sufficient to ensure a substantially constant spacing between plate structures 40 and 42 along composite outer-wall portion 110B/110C/110D, one or more spacer supports that extends from lower outer-wall portion 110D to upper outer-wall portion 110B can be placed in cavity 112.

Getter 50, 74, 94, or 114 can be also replaced with a getter of the evaporable type. Although getter supports 52, 82, 102, or 116 are typically eliminated in this case, the gettering material could be evaporatively deposited on material that thermally (and electrically) insulates the evaporable getter from the active display components.

Instead of using gap jumping and/or radiative heating in sealing the flat-panel display, the display can be sealed by local heating with a laser after bringing the top edge of outer wall 44 or 110 substantially into contact with the interior surface of baseplate structure 40. Outer wall 44 can be joined to baseplate structure 40 after which faceplate structure 42 is sealed to outer wall 44. Laser 58 and/or laser 62 can be located inside vacuum chamber 56.

The flat-panel CRT display can employ a thermionic-emission technique rather than a field-emission technique. The invention can be employed to activate getters in flat-panel devices other than displays. Getters situated in hollow structures other than flat-panel devices can be sealed by using the laser activation technique of the invention.

Light energy sources such as a focused lamp having a suitable spectral output can be employed in place of a laser for activating getter 50, 74, 94, or 114. Furthermore, getter 50, 74, 94, or 114 in a flat-panel CRT display can be activated/re-activated with any energy source that produces a sufficiently strong beam of energy which can be directed locally onto the getter without significantly heating components through which the energy beam is intended to pass before reaching the getter and without having the beam impinge significantly on any other components of the CRT display except for the material through which the beam is intended to pass. Examples include locally directed RF energy, including locally-directed microwave energy which falls near the middle of the RF band. Various modifications and applications may thus be made by those skilled in the art without departing from the true scope and spirit of the invention as defined in the appended claims.

We claim:

1. A flat-panel device comprising:

a main compartment formed with a first plate structure and a second plate structure situated opposite to, and coupled to, the first plate structure;

a plurality of spacer walls extending generally parallel to one another between the plate structures;

an auxiliary compartment (a) formed with an auxiliary wall coupled to the first plate structure and (b) connected pressure-wise to the main compartment through a plurality of openings in the first plate structure so that the two compartments reach largely equal steady-state compartment pressures; and a getter situated in the auxiliary compartment, the getter comprising a getter strip extending generally perpendicular to the spacer walls.

2. A device as in claim 1 wherein:

the first plate structure is controlled to selectively emit electrons; and the second plate structure emits light to produce an image in response to electrons received from the first plate structure.

3. A device as in claim 1 wherein the main compartment is also formed with a generally annular outer wall through which the plate structures are coupled to each other.

4. A flat-panel device comprising:

a main compartment formed with a first plate structure and a second plate structure situated opposite to, and coupled to, the first plate structure;

an auxiliary compartment (a) formed with an auxiliary wall coupled to the first plate structure and (b) connected pressure-wise to the main compartment through at least one opening through the first plate structure so that the two compartments reach largely equal steady-state compartment pressures;

a getter situated in the auxiliary compartment; and additional component material situated over the first plate structure outside the compartments, the additional component material comprising control circuitry, the auxiliary wall not extending significantly further away from the first plate structure than the additional component material.

5. A device as in claim 4 wherein:

the first plate structure is controlled to selectively emit electrons; and the second plate structure emits light to produce an image in response to electrons received from the first plate structure.

6. A device as in claim 4 wherein the main compartment is also formed with a generally annular outer wall through which the plate structures are coupled to each other.

7. A device as in claim 4 wherein the control circuitry and the auxiliary wall extend to approximately the same distance away from the first plate structure.

8. A device as in claim 4 further including a pump-out port connected pressure wise to the auxiliary compartment.

9. A device as in claim 8 wherein the pump-out port extends approximately parallel to the first plate structure.

10. A device as in claim 4 wherein the getter is situated within the auxiliary compartment at a location suitable for being activated by light energy transferred locally through the auxiliary wall.

11. A flat-panel device comprising:

a main compartment comprising a first plate structure, a second plate structure, and a generally annular outer wall that extends between the plate structures;

an auxiliary compartment situated over the first plate structure outside the main compartment and connected pressure-wise to the main compartment so that the two compartments reach largely equal steady-state compartment pressures;

a getter situated in the auxiliary compartment; and control circuitry situated over the first plate structure outside the compartments, the auxiliary compartment not extending significantly further away from the first plate structure than the control circuitry.

12. A device as in claim 11 wherein the compartments are connected together through at least one opening in the first plate structure.

13. A device as in claim 11 wherein the getter is situated within the auxiliary compartment at a location suitable for being activated by light energy transferred locally through a wall of the auxiliary compartment.

14. A device as in claim 11 further including a plurality of spacer walls extending generally parallel to one another between the plate structures and extending generally perpendicular to the getter.

15. A device as in claim 11 further including getter support means for supporting the getter and thermally insulating it from the compartments.

16. A device as in claim 11 wherein the getter comprises a piece of non-evaporable gettering material.

17. A device as in claim 11 further including a pump-out port connected pressure-wise to the auxiliary compartment.

18. A device as in claim 17 wherein the pump-out port extends approximately parallel to the first plate structure.

19. A device as in claim 18 wherein the pump-out port, when closed, does not extend significantly laterally beyond the first plate structure.

20. A device as in claim 11 wherein the compartments, getter, and control circuitry are components of a flat-panel display for which the second plate structure contains a faceplate on which an image produced by the flat-panel display is visible.

21. A device as in claim 20 wherein:

the first plate structure contains multiple electron-emissive elements; and the second plate structure contains multiple light-emissive elements that emit light upon being struck by electrons emitted from the electron-emissive elements.

22. A flat-panel device comprising:

a main compartment formed with a first plate structure, a second plate structure, and a generally annular outer wall that extends between the plate structures;

an auxiliary compartment situated outside the main compartment, the auxiliary compartment formed with an auxiliary wall that contacts the first plate structure outside the main compartment, extends away from the first plate structure and main compartment, bends back towards the second plate structure, and contacts the second plate structure outside the main compartment, the auxiliary compartment connected pressure-wise to the main compartment so that the two compartments reach largely equal steady-state compartment pressures;

a getter situated in the auxiliary compartment; and a pump-out port connected directly to the auxiliary compartment, extending approximately parallel to the first plate structure, and, when closed, not extending significantly laterally beyond the first plate structure.

23. A device as in claim 22 wherein the pump-out port, when closed, does not extend significantly further away from the first plate structure than the auxiliary wall.

24. A device as in claim 22 wherein the compartments are connected together through at least one opening in the outer wall.

25. A device as in claim 22 further including control circuitry situated over the first plate structure outside the compartments, the auxiliary wall not extending significantly further away from the first plate structure than the control circuitry.

26. A device as in claim 22 wherein the getter is situated within the auxiliary compartment at a location suitable for being activated by light energy transferred locally through the auxiliary wall.

27. A device as in claim 22 further including a plurality of spacer walls extending generally parallel to one another between the plate structures and extending generally perpendicular to the getter.

28. A device as in claim 22 wherein the plate structures, walls, getter, and pump-out port are components of a flat-panel display for which the second plate structure contains a faceplate on which an image produced by the flat-panel display is visible.

29. A device as in claim 20 wherein:

the first plate structure contains multiple electron-emissive elements; and the second plate structure contains multiple light-emissive elements that emit light upon being struck by electrons emitted from the electron-emissive elements.

30. A flat-panel device comprising:

a main compartment formed with a first plate structure and a second plate structure situated opposite to, and coupled to, the first plate structure;

an auxiliary compartment (a) formed with an auxiliary wall coupled to the first plate structure and (b) connected pressure-wise to the main compartment through at least one opening through the first plate structure so that the two compartments reach largely equal steady-state compartment pressures;

a getter situated in the auxiliary compartment;

a pump-out port connected pressure-wise to the auxiliary compartment, the pump-out port extending approximately parallel to the first plate structure; and additional component material situated over the first plate structure outside the compartments, the auxiliary wall not extending significantly further away from the first plate structure than the additional component material.

31. A device as in claim 30 wherein:

the first plate structure is controlled to selectively emit electrons; and the second plate structure emits light to produce an image in response to electrons received from the first plate structure.

32. A device as in claim 30 wherein the main compartment is also formed with a generally annular outer wall through which the plate structures are coupled to each other.

33. A device as in claim 30 wherein the getter is situated within the auxiliary compartment at a location suitable for being activated by light energy transferred locally through the auxiliary wall.

34. A flat-panel device comprising:

a main compartment formed with a first plate structure and a second plate structure situated opposite to, and coupled to, the first plate structure;

an auxiliary compartment (a) formed with an auxiliary wall coupled to the first plate structure and (b) connected pressure-wise to the main compartment through at least one opening through the first plate structure so that the two compartments reach largely equal steady-state compartment pressures;

a getter situated in the auxiliary compartment at a location suitable for being activated by light energy transformed locally through the auxiliary wall; and additional component material situated over the first plate structure outside the compartments, the auxiliary wall not extending significantly further away from the first plate structure than the additional component material.

35. A device as in claim 34 wherein:

the first plate structure is controlled to selectively emit electrons; and the second plate structure emits light to produce an image in response to electrons received from the first plate structure.

36. A device as in claim 34 wherein the main compartment is also formed with a generally annular outer wall through which the plate structures are coupled to each other.

* * * * *